US010895435B2

(12) United States Patent
Schulz

(10) Patent No.: US 10,895,435 B2
(45) Date of Patent: Jan. 19, 2021

(54) FIREARM SIMULATOR TARGETS AND FIREARM SIMULATION SYSTEMS

(71) Applicant: Kurt S. Schulz, Cincinnati, OH (US)

(72) Inventor: Kurt S. Schulz, Cincinnati, OH (US)

( * ) Notice: Subject to any disclaimer, the term of this patent is extended or adjusted under 35 U.S.C. 154(b) by 387 days.

(21) Appl. No.: 15/903,567

(22) Filed: Feb. 23, 2018

(65) Prior Publication Data

US 2018/0245881 A1 Aug. 30, 2018

Related U.S. Application Data

(60) Provisional application No. 62/463,924, filed on Feb. 27, 2017.

(51) Int. Cl.
*F41G 3/26* (2006.01)
*F41J 5/02* (2006.01)
(Continued)

(52) U.S. Cl.
CPC ..... *F41G 3/2627* (2013.01); *F41G 3/2633* (2013.01); *F41G 3/2655* (2013.01); *F41J 1/00* (2013.01); *F41J 5/02* (2013.01); *F41A 33/02* (2013.01); *F41A 33/04* (2013.01); *F41J 5/14* (2013.01); *F41J 5/24* (2013.01)

(58) Field of Classification Search
CPC ..... F41A 33/02; F41A 33/04; F41G 3/2627; F41G 3/2633; F41G 3/2655; F41J 1/00; F41J 5/02; F41J 5/14; F41J 5/24
See application file for complete search history.

(56) References Cited

U.S. PATENT DOCUMENTS 3,811,204 A 5/1974 Marshall et al.
4,063,368 A * 12/1977 McFarland ..... F41G 3/2655 434/22

(Continued)

FOREIGN PATENT DOCUMENTS

EP 1049055 B1 3/2013
WO 2011067117 A1 6/2011

OTHER PUBLICATIONS

EEWEB, Using LED As a Light Sensor, Apr. 18, 2013, https://www.eeweb.com/blog/extreme_circuits/using-led-as-a-light-sensor.

(Continued)

*Primary Examiner* — Nathan Hillery
(74) *Attorney, Agent, or Firm* — Dinsmore & Shohl LLP

(57) ABSTRACT

Firearm simulator targets and firearm simulation systems are disclosed. A firearm simulator target includes a processor, a memory module, a plurality of light emitting diodes, and machine readable instructions stored in the memory module. When executed by the processor, the machine readable instructions cause the firearm simulator target to illuminate a target pattern subset of the plurality of light emitting diodes such that the target pattern subset of the plurality of light emitting diodes are illuminated to display a target pattern. The target pattern subset of the plurality of light emitting diodes that are illuminated includes a first light emitting diode. When executed by the processor, the machine readable instructions further cause the firearm simulator target to receive a signal from the first light emitting diode, and determine a target hit location at the first light emitting diode based on the signal received from the first light emitting diode.

8 Claims, 12 Drawing Sheets

(51) Int. Cl.

| | |
|---|---|
| ***F41J 1/00*** | (2006.01) |
| ***F41A 33/04*** | (2006.01) |
| ***F41A 33/02*** | (2006.01) |
| ***F41J 5/14*** | (2006.01) |
| ***F41J 5/24*** | (2006.01) |

(56) References Cited

U.S. PATENT DOCUMENTS 4,564,756 A 1/1986 Johnson
5,097,299 A 3/1992 Donhowe et al.
5,399,853 A 3/1995 Maurice
5,448,082 A 9/1995 Kim
5,525,539 A 6/1996 Kim
5,541,704 A 7/1996 Dunsmore
5,842,300 A * 12/1998 Cheshelski ..... F41A 33/02 42/116
5,856,727 A 1/1999 Schroeder et al.
6,007,429 A 12/1999 Lubniewski
6,136,627 A 10/2000 Ogihara et al.
6,322,365 B1 11/2001 Shechter et al.
6,473,980 B2 11/2002 Ripingill et al.
6,575,753 B2 6/2003 Rosa et al.
6,616,452 B2 9/2003 Clark et al.
6,966,775 B1 11/2005 Kendir et al.
7,141,779 B1 11/2006 Chew et al.
7,329,127 B2 2/2008 Kendir et al.
7,557,690 B2 7/2009 McMahon
8,632,338 B2 1/2014 Miasnik
8,888,490 B2 11/2014 Cederwall
9,041,697 B2 5/2015 Soto
9,146,082 B2 9/2015 Graham et al.
9,207,851 B1 12/2015 Han
9,226,367 B1 12/2015 Sivertsen
9,250,039 B2 2/2016 Matthews et al.
9,303,960 B2 4/2016 Uhr
9,313,855 B1 4/2016 Sivertsen
9,386,668 B2 7/2016 Knapp et al.
9,429,404 B2 8/2016 Moore et al.
2002/0012898 A1 1/2002 Shechter et al.
2003/0091960 A1 * 5/2003 Rosa ..... F41G 3/2655 434/21
2003/0189211 A1 10/2003 Dietz
2003/0195046 A1 * 10/2003 Bartsch ..... F41G 3/2683 463/49
2003/0197113 A1 10/2003 Pitigoi-Aron et al.
2004/0014010 A1 * 1/2004 Swensen ..... F41J 5/02 434/21
2005/0118556 A1 6/2005 Watanabe et al.
2005/0153262 A1 * 7/2005 Kendir ..... G09B 19/0038 434/21
2006/0072319 A1 4/2006 Dziekan et al.
2007/0077539 A1 * 4/2007 Tzidon ..... F41G 3/2661 434/21
2007/0190495 A1 8/2007 Kendir et al.
2008/0208488 A1 8/2008 Yang et al.
2010/0092925 A1 * 4/2010 Lvovskiy ..... F41J 5/10 434/22
2011/0063214 A1 3/2011 Knapp
2011/0207088 A1 * 8/2011 Uhr ..... G09B 5/00 434/21
2012/0319592 A1 12/2012 Riesebosch
2013/0221851 A1 8/2013 Coates
2013/0309633 A1 11/2013 Carriere
2014/0349254 A1 11/2014 Lohbihler
2015/0024815 A1 1/2015 Chen et al.
2015/0125828 A1 * 5/2015 Otte ..... F41A 33/02 434/11
2015/0348504 A1 12/2015 Sakariya et al.
2015/0354922 A1 12/2015 Carriere
2015/0369572 A1 12/2015 Smolka
2016/0033240 A1 2/2016 Graham et al.
2016/0081155 A1 3/2016 Campbell et al.
2016/0138892 A1 5/2016 Matthews et al.
2016/0169608 A1 * 6/2016 Schulz ..... F41A 33/02 434/22
2016/0245624 A1 8/2016 Haasnoot et al.
2016/0273888 A1 9/2016 English et al.
2017/0248388 A1 * 8/2017 Young ..... F41A 19/01
2019/0013644 A1 * 1/2019 Nerheim ..... G01J 1/4257

OTHER PUBLICATIONS

Gonzalez, "The LED Sensing Matrix", Nov. 16, 2016, http://www.jtgonz.com/led-sensing-matrix.html.

Target Pro, "Revolutionizing Home Firearm Training", Nov. 4, 2016, https://www.itargetpro.com/.

Messtechnik Gmbh, "Precise Laser Target PLT 2", Nov. 4, 2016, http://www.plt2.de/en/precise_laser_target.html#details.

Radcliffe, "ME456: Mechatronics Systems Design, Chapter 7: Measuring Light with an LED", Michigan State University, Sep. 28, 2012, http://www.egr.msu.edu/classes/me456/radcliff.

* cited by examiner

FIREARM SIMULATOR TARGETS AND FIREARM SIMULATION SYSTEMS

CROSS-REFERENCE TO RELATED APPLICATIONS

This application claims the benefit of U.S. Provisional Patent Application No. 62/463,924, filed on Feb. 27, 2017 and entitled "FIREARM SIMULATOR TARGETS AND FIREARM SIMULATOR SYSTEMS."

TECHNICAL FIELD

The present specification relates to firearm simulator targets and firearm simulation systems.

BACKGROUND

Firearm simulation systems include firearm simulators that may be used to simulate the "firing" of a firearm at a firearm simulator target without requiring the use of live ammunition. Such firearm simulation systems are widely recognized as an effective means for improving firearm handling and shooting skills.

SUMMARY

In some embodiments, a firearm simulator target includes a processor, a memory module communicatively coupled to the processor, a plurality of light emitting diodes communicatively coupled to the processor, and machine readable instructions stored in the memory module. When executed by the processor, the machine readable instructions cause the firearm simulator target to illuminate a target pattern subset of the plurality of light emitting diodes such that the target pattern subset of the plurality of light emitting diodes are illuminated to display a target pattern. The target pattern subset of the plurality of light emitting diodes that are illuminated includes a first light emitting diode. When executed by the processor, the machine readable instructions further cause the firearm simulator target to receive a signal from the first light emitting diode, and determine a target hit location at the first light emitting diode based on the signal received from the first light emitting diode.

In another embodiment, a firearm simulator target includes a processor, a memory module communicatively coupled to the processor, a plurality of light emitting diodes communicatively coupled to the processor, and machine readable instructions stored in the memory module. The plurality of light emitting diodes are arranged in a light emitting diode matrix such that the plurality of light emitting diodes are arranged in a plurality of columns of light emitting diodes and a plurality of rows of light emitting diodes. The plurality of light emitting diodes includes a first light emitting diode. The first light emitting diode is associated with a first row of light emitting diodes of the plurality of rows of light emitting diodes. The first light emitting diode is associated with a first column of light emitting diodes of the plurality of columns of light emitting diodes. When executed by the processor, the machine readable instructions cause the firearm simulator target to illuminate a target pattern subset of the plurality of light emitting diodes such that the target pattern subset of the plurality of light emitting diodes are illuminated to display a target pattern. The target pattern subset of the plurality of light emitting diodes that are illuminated includes the first light emitting diode. When executed by the processor, the machine readable instructions further cause the firearm simulator target to receive a signal from the first light emitting diode, determine a row hit location as the first row of light emitting diodes based on the signal received from the first light emitting diode, determine a column hit location as the first column of light emitting diodes based on the signal received from the first light emitting diode, and determine a target hit location at the first light emitting diode based on the column hit location and the row hit location.

In yet another embodiment, a firearm simulation system includes a firearm simulator and a firearm simulator target. The firearm simulator includes a first processor, a first memory module communicatively coupled to the first processor, a trigger unit communicatively coupled to the first processor, wherein the trigger unit outputs a trigger output signal, an optoelectronic output device communicatively coupled to the first processor, wherein the optoelectronic output device outputs light when activated, and first machine readable instructions stored in the first memory module. When executed by the first processor, the first machine readable instructions cause the firearm simulator to determine whether a trigger break event has occurred based on the trigger output signal, and activate the optoelectronic output device in order to produce light when the trigger break event has occurred. The firearm simulator target includes a second processor, a second memory module communicatively coupled to the second processor, a plurality of light emitting diodes communicatively coupled to the second processor, and second machine readable instructions stored in the second memory module. When executed by the second processor, the second machine readable instructions cause the firearm simulator target to illuminate a target pattern subset of the plurality of light emitting diodes such that the target pattern subset of the plurality of light emitting diodes are illuminated to display a target pattern. The target pattern subset of the plurality of light emitting diodes that are illuminated includes a first light emitting diode. When executed by the second processor, the second machine readable instructions further cause the firearm simulator target to receive a signal from the first light emitting diode in response to the light produced by the optoelectronic output device of the firearm simulator and determine a target hit location at the first light emitting diode based on the signal received from the first light emitting diode.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

The firearm simulation systems described herein include firearm simulators and firearm simulator targets that allow a shooter to perform dry fire exercises safely while receiving visual and audible feedback regarding shooting accuracy, timing, and control. Embodiments described herein may be used to provide a dry fire training experience with significantly enhanced simulations, adding feedback and realism to a much greater extent and with a lower expense than found in existing firearm training systems. Embodiments of firearm simulator targets described herein that use the same light emitting diodes to display target patterns and sense target hits eliminate the need for discrete photo sensors for hit detection, which may increase the density and resolution of the electronic components, decrease physical size and decrease implementation costs as compared to embodiments that may use separate photo sensors and light emitting diodes. Embodiments described herein may facilitate fast and simple target setup and take-down, allow flexible target arrangements that cover multiple locations over a wide area and at varying distances, provide a wide variety of courses of fire with dynamically changing target patterns, allow hits within target zones to be detected for immediate feedback on accuracy and scoring, allow for use in a wide range of lighting conditions, provide audible and visual feedback of hits on targets, and provide low-cost implementation.

Embodiments of firearm simulators and firearm simulation systems will be described in more detail herein with reference to the attached figures.

Figure 1:
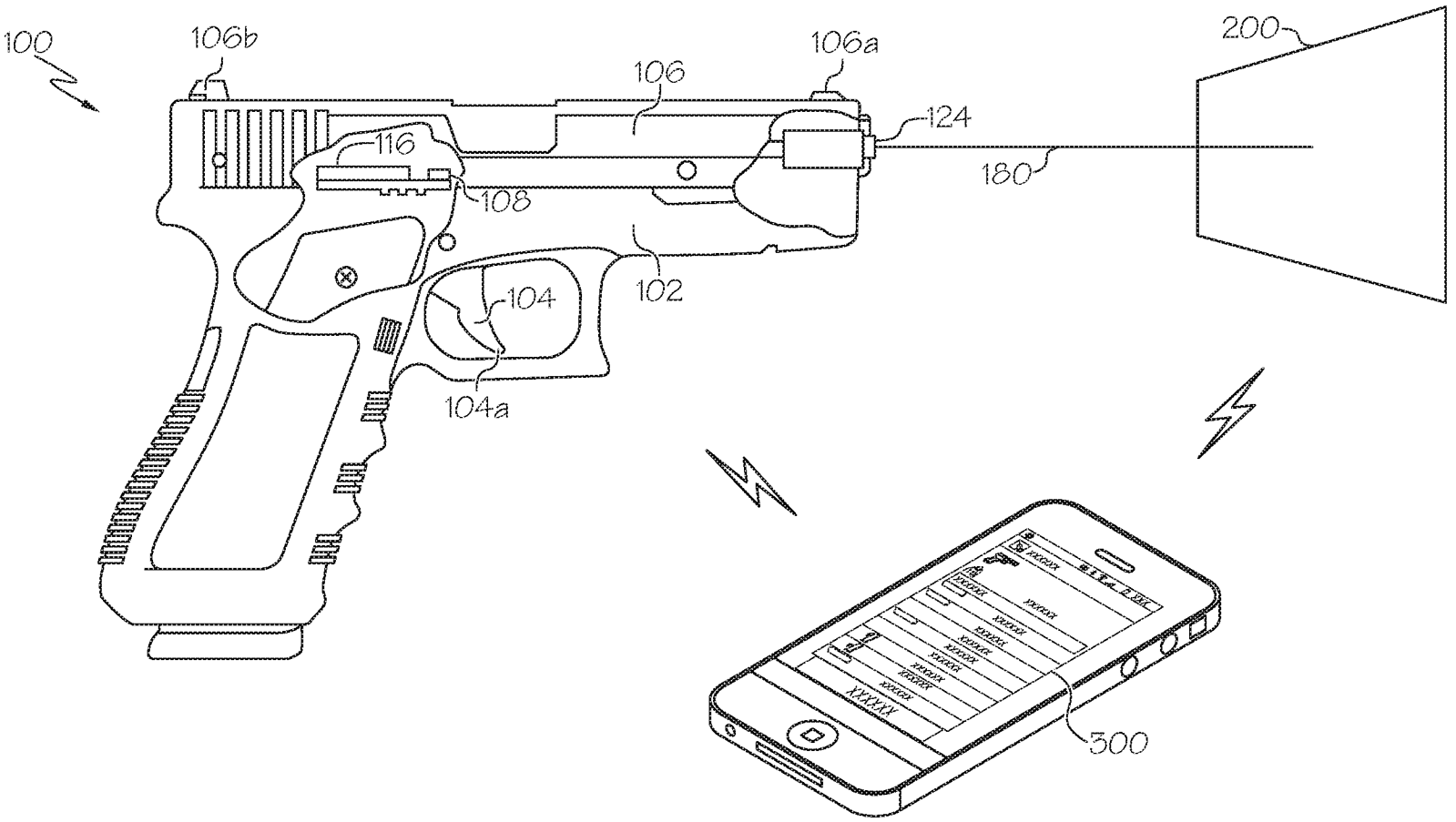
FIG. 1 schematically depicts a firearm simulation system including a firearm simulator, a firearm simulator target, and a computing device in communication with the firearm simulator and the firearm simulator target, according to one or more embodiments shown and described herein.

Referring now to FIG. 1, a firearm simulation system including a firearm simulator 100, a firearm simulator target 200, and a computing device 300 is schematically depicted. The firearm simulator 100 and its components and the firearm simulator target 200 and its components will now be described in turn.

Still referring to FIG. 1, the firearm simulator 100 includes a firearm frame 102, a trigger unit 104, a firearm slide 106, a battery 108, an electronic control unit 112, and an optoelectronic output device 124, each of which will be described in turn.

Still referring to FIG. 1, the firearm frame 102 houses or is coupled to the other components of the firearm simulator 100. In the embodiment depicted in FIG. 1, the firearm frame 102 has a pistol shape. In other embodiments, the firearm frame 102 may have a different shape, such as in embodiments in which the firearm frame 102 has a revolver shape, a rifle shape, a submachine gun shape, a machine gun shape, or a shape of another type of firearm.

Still referring to FIG. 1, the trigger unit 104 of the firearm simulator 100 is housed within the firearm frame 102, such that the trigger 104*a* of the trigger unit 104 protrudes from the firearm frame 102 in a manner that allows the trigger 104*a* to be manipulated by a user of the firearm simulator 100. The trigger unit 104 is communicatively coupled to the electronic control unit 112 and provides a trigger output signal to the electronic control unit 112 that is indicative of a position of the trigger 104*a*. In some embodiments, the trigger output signal may include a trigger break signal indicative that the trigger 104*a* is in a trigger break state. As used herein, a "trigger break state" is a state in which a position of the trigger 104*a* has moved beyond the trigger prep threshold position to a trigger break threshold position. The trigger 104*a* may be in the trigger break state when the trigger 104*a* is positioned between the trigger break threshold position and a terminal trigger position (i.e. a position of the trigger when maximal force is applied to the trigger). In some embodiments, the trigger output signal is proportional to a linear position of the trigger 104*a*.

Still referring to FIG. 1, the firearm simulator 100 includes the firearm slide 106. When the firearm simulator is assembled, the firearm slide 106 forms an upper portion of the firearm simulator 100. The firearm slide 106 includes a front sight 106*a* and a rear sight 106*b* along a top of the firearm slide 106. The front sight 106*a* and the rear sight 106*b* may be used by a user of the firearm simulator 100 to aim the firearm simulator 100 toward a target. In some embodiments, the firearm slide 106 may be easily removed from the firearm simulator 100 such that the internal electronic components (e.g., the battery 108, the trigger unit 104, etc.) of the firearm simulator 100 may be accessed.

Still referring to FIG. 1, the battery 108 of the firearm simulator 100 may be electrically connected to one or more of the electronic components of the firearm simulator 100 and may provide power to one or more of the electronic components of the firearm simulator 100. In some embodiments, the battery 108 is a 3V Lithium battery, though embodiments are not limited thereto. In some embodiments, the firearm simulator 100 may not include a battery, such as embodiments in which the firearm simulator 100 includes a solar power cell, or the like.

Still referring to FIG. 1, the electronic control unit 112 is housed and mounted within the firearm frame 102. In some embodiments, the electronic control unit 112 includes a processor (e.g., the processor 134 shown in FIG. 2), a memory module (e.g., the memory module 132 shown in FIG. 2), and network interface hardware (e.g., the network interface hardware 136 shown in FIG. 2). Further details regarding the processor, the memory module, and the network interface hardware are provided below with reference to FIG. 2. Referring once again to FIG. 1, some embodiments may not include a processor, a memory module, and network interface hardware as part of a single electronic control unit 112. For example, in some embodiments, the processor, the memory module, and the network interface hardware may be distributed among more than one component.

Still referring to FIG. 1, the optoelectronic output device 124 is coupled to the firearm frame 102 such that the optoelectronic output device 124 is oriented in a direction parallel to the longitudinal direction in which the firearm slide extends. The optoelectronic output device 124 outputs light when activated to simulate a shot fired with the output light. In some embodiments, the optoelectronic output device 124 is a laser diode (e.g., a class 3R 5 mw red (650 nm) or green (532 nm) laser diode), though embodiments are not limited thereto.

Still referring to FIG. 1, the computing device 300, the firearm simulator 100, and the firearm simulator target 200 are communicatively coupled via one or more networks. In some embodiments, the one or more networks includes a personal area network that utilizes Bluetooth® technology (e.g., Bluetooth® 4.0) to communicatively couple the computing device 300 with one or both of the firearm simulator 100 and the firearm simulator target 200. In some embodiments, the one or more networks includes one or more computer networks (e.g., a personal area network, a local area network, or a wide area network), cellular networks, satellite networks and combinations thereof. Accordingly, the firearm simulator 100, the firearm simulator target 200, and the computing device 300 can be communicatively coupled to one another via wires, via a wide area network, via a local area network, via a personal area network, via a cellular network, via a satellite network, etc. Suitable local area networks may include wired Ethernet and/or wireless technologies such as, for example, wireless fidelity (Wi-Fi). Suitable personal area networks may include wireless technologies such as, for example, IrDA, Bluetooth®, Wireless USB, Z-Wave, ZigBee, and/or other near field communication protocols. Suitable personal area networks may similarly include wired computer buses such as, for example, USB and FireWire. Suitable cellular networks include, but are not limited to, technologies such as LTE, WiMAX, UMTS, CDMA, and GSM. In some embodiments, the firearm simulator 100 is communicatively coupled to the computing device 300, which in turn is communicatively coupled to the firearm simulator target 200. In some embodiments, such as embodiments that do not include the computing device 300, the firearm simulator 100 and the firearm simulator target 200 are communicatively coupled. In some embodiments, all of the firearm simulator 100, the firearm simulator target 200, and the computing device 300 are communicatively coupled to one another so that each component can communicate with the other components.

Still referring to FIG. 1, the computing device 300 may include a mobile phone, a smartphone, a personal digital assistant, a dedicated mobile media player, a mobile personal computer, a tablet computer, a laptop computer, a desktop computer and/or any other computing device capable of being communicatively coupled with the firearm simulator 100 and/or the firearm simulator target 200. The computing device 300 includes a processor, a memory module, network interface hardware, a speaker, and a display. The processor of the computing device 300 can execute logic to communicate with the firearm simulator 100 and/or the firearm simulator target 200 and to perform the functionality described herein. The computing device 300 may be configured with network interface hardware for communicating with the firearm simulator 100 and/or the firearm simulator target 200. In some embodiments, the computing device 300 comprises a display for providing visual output. The computing device 300 may also transmit information to the firearm simulator 100 and/or to the firearm simulator target 200 to configure the firearm simulator 100 and/or the firearm simulator target 200 or to control one or more functions of the firearm simulator 100 and/or the firearm simulator target 200, as will be described further below.

Figure 2:
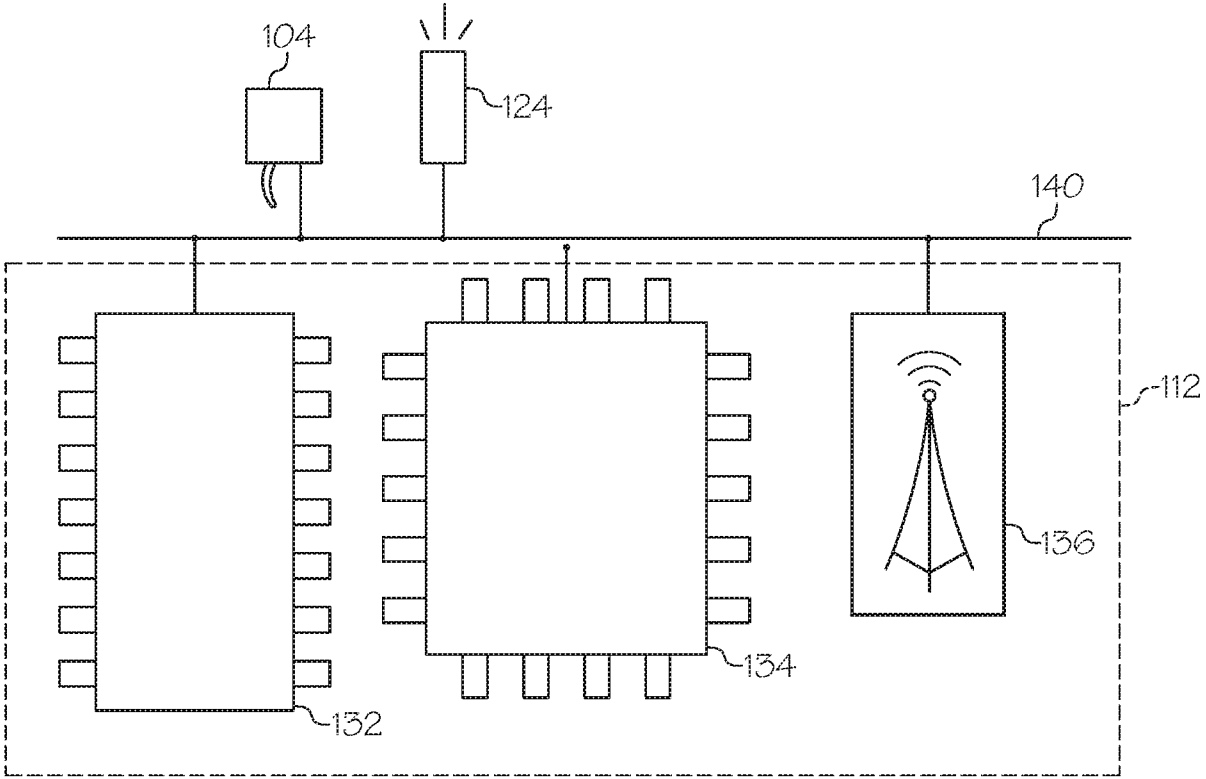
FIG. 2 schematically depicts a diagram of various electronic components of the firearm simulator of FIG. 1, according to one or more embodiments shown and described herein.

Referring now to FIG. 2, a schematic diagram depicting various electronic components of the firearm simulator 100 is provided. The components depicted in FIG. 2 include an electronic control unit 112, the trigger unit 104, and the optoelectronic output device 124. The electronic control unit 112 includes the memory module 132, the processor 134, and network interface hardware 136. The components are interconnected by a communication path 140.

Still referring to FIG. 2, the communication path 140 may be formed from any medium that is capable of transmitting a signal such as, for example, conductive wires, conductive traces, optical waveguides, or the like. Moreover, the communication path 140 may be formed from a combination of mediums capable of transmitting signals. In some embodiments, the communication path 140 comprises a combination of conductive traces, conductive wires, connectors, and buses that cooperate to permit the transmission of electrical data signals to components such as processors, memories, sensors, input devices, output devices, and communication devices. The term "signal" means a waveform (e.g., electrical, optical, magnetic, mechanical or electromagnetic), such as DC, AC, sinusoidal-wave, triangular-wave, square-wave, vibration, and the like, capable of traveling through a medium. The communication path 140 communicatively couples the various components of the firearm simulator 100. As used herein, the term "communicatively coupled" means that coupled components are capable of exchanging data signals with one another such as, for example, electrical signals via conductive medium, electromagnetic signals via air, optical signals via optical waveguides, and the like.

Still referring to FIG. 2, the processor 134 may be any device capable of executing machine readable instructions. Accordingly, the processor 134 may be an electronic control unit, an integrated circuit, a microchip, a computer, or any other computing device. The processor 134 is communicatively coupled to the other components of the firearm simulator 100 by the communication path 140. While the embodiment depicted in FIG. 2 includes only one processor 134, other embodiments may include multiple processors communicatively coupled with one another by the communication path 140.

Still referring to FIG. 2, the memory module 132 of the firearm simulator 100 is coupled to the communication path 140 and communicatively coupled to the processor 134. The memory module 132 may comprise RAM, ROM, flash memories, hard drives, or any device capable of storing machine readable instructions such that the machine readable instructions can be accessed and executed by the processor 134. The machine readable instructions may comprise logic or algorithm(s) written in any programming language of any generation (e.g., 1GL, 2GL, 3GL, 4GL, or 5GL) such as, for example, machine language that may be directly executed by the processor, or assembly language, object-oriented programming (OOP), scripting languages, microcode, etc., that may be compiled or assembled into machine readable instructions and stored on the memory module 132. Alternatively, the machine readable instructions may be written in a hardware description language (HDL), such as logic implemented via either a field-programmable gate array (FPGA) configuration or an application-specific integrated circuit (ASIC), or their equivalents. Accordingly, the functionality described herein may be implemented in any conventional computer programming language, as pre-programmed hardware elements, or as a combination of hardware and software components.

Still referring to FIG. 2, the network interface hardware 136 is coupled to the communication path 140 and communicatively coupled to the processor 134. The network interface hardware 136 may be any device capable of transmitting and/or receiving data via a network. Accordingly, the network interface hardware 136 can include a communication transceiver for sending and/or receiving any wired or wireless communication. For example, the network interface hardware 136 may include an antenna, a modem, LAN port, Wi-Fi card, WiMax card, mobile communications hardware, near-field communication hardware, satellite communication hardware and/or any wired or wireless hardware for communicating with other networks and/or devices. In some embodiments, the network interface hardware 136 includes hardware configured to operate in accordance with the Bluetooth® wireless communication protocol. In some embodiments, the network interface hardware 136 may be a wireless communication module configured to transmit and/or receive wireless signals according to the Bluetooth® 4.0 communication protocol. In such embodiments, the network interface hardware 136 may transmit and receive signals using less energy than other less energy efficient wireless communication protocols. However, in some embodiments the network interface hardware 136 is configured to transmit and/or receive wireless signals in accordance with a wireless communication protocol other than the Bluetooth® 4.0 communication protocol.

Still referring to FIG. 2, the trigger unit 104 is coupled to the communication path 140 and communicatively coupled to the processor 134. In some embodiments, the trigger unit 104 includes one or more electrical switches that change the output of the trigger unit 104 when the one or more electrical switches are opened or closed. The trigger unit 104 outputs a trigger output signal indicative of a position of the trigger of the trigger unit 104. In some embodiments, the trigger output signal may include a trigger prep signal indicative that the trigger is in a trigger prep state, and a trigger break signal indicative that the trigger is in a trigger break state. In some embodiments, the trigger unit 104 may only output a single trigger output signal, such as embodiments in which the trigger output signal is proportional to a linear position of the trigger.

Still referring to FIG. 2, the optoelectronic output device 124 is coupled to the communication path 140 and communicatively coupled to the processor 134. The optoelectronic output device 124 outputs light when activated to simulate a shot fired with the output light. In some embodiments, the optoelectronic output device 124 is activated or deactivated in response to machine readable instructions executed by the processor 134.

In some embodiments, the processor 134, the memory module 132, and the network interface hardware 136 may be components of an electronic control unit, such as the electronic control unit 112 of FIG. 1. In such embodiments, the electronic control unit 112 may be communicatively coupled to the trigger unit 104 and the optoelectronic output device 124, such as when at least one output or input of each of the trigger unit 104 and the optoelectronic output device 124 are connected to at least one pin of the electronic control unit 112.

Figure 3:
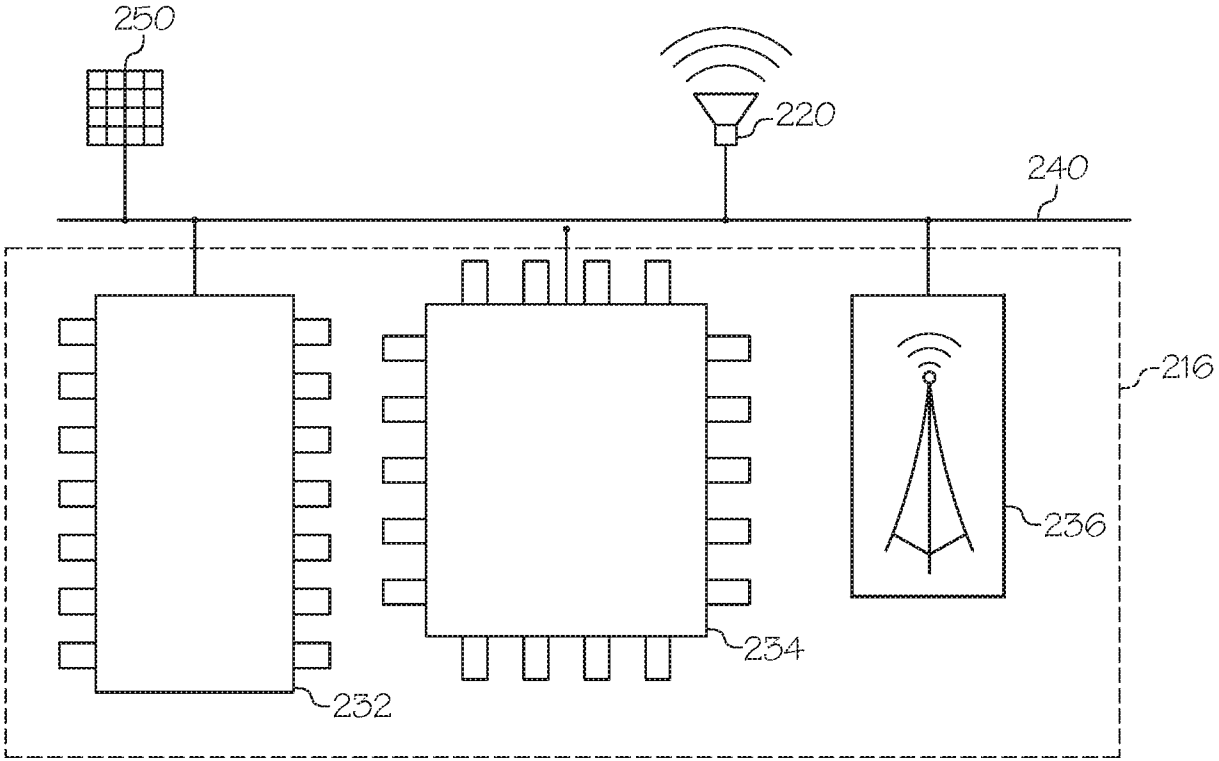
FIG. 3 schematically depicts a diagram of various electronic components of the firearm simulator target of FIG. 1, according to one or more embodiments shown and described herein.

Referring now to FIG. 3, a schematic diagram depicting various electronic components of the firearm simulator target 200 is provided. The components depicted in FIG. 3 include an electronic control unit 216, a speaker 220, and a plurality of light emitting diodes 250. The electronic control unit 216 includes a memory module 232, a processor 234, and network interface hardware 236. The components are interconnected by a communication path 240.

Still referring to FIG. 3, the communication path 240 may be formed from any medium that is capable of transmitting a signal such as, for example, conductive wires, conductive traces, optical waveguides, or the like. Moreover, the communication path 240 may be formed from a combination of mediums capable of transmitting signals. In some embodiments, the communication path 240 comprises a combination of conductive traces, conductive wires, connectors, and buses that cooperate to permit the transmission of electrical data signals to components such as processors, memories, sensors, input devices, output devices, and communication devices. The term "signal" means a waveform (e.g., electrical, optical, magnetic, mechanical or electromagnetic), such as DC, AC, sinusoidal-wave, triangular-wave, square-wave, vibration, and the like, capable of traveling through a medium. The communication path 240 communicatively couples the various components of the firearm simulator target 200. As used herein, the term "communicatively coupled" means that coupled components are capable of exchanging data signals with one another such as, for example, electrical signals via conductive medium, electromagnetic signals via air, optical signals via optical waveguides, and the like.

Still referring to FIG. 3, the processor 234 may be any device capable of executing machine readable instructions. Accordingly, the processor 234 may be an electronic control unit, an integrated circuit, a microchip, a computer, or any other computing device. The processor 234 is communicatively coupled to the other components of the firearm simulator target 200 by the communication path 240. While the embodiment depicted in FIG. 3 includes only one processor 234, other embodiments may include multiple processors communicatively coupled with one another by the communication path 240.

Still referring to FIG. 3, the memory module 232 of the firearm simulator target 200 is coupled to the communication path 240 and communicatively coupled to the processor 234. The memory module 232 may comprise RAM, ROM, flash memories, hard drives, or any device capable of storing machine readable instructions such that the machine readable instructions can be accessed and executed by the processor 234. The machine readable instructions may comprise logic or algorithm(s) written in any programming language of any generation (e.g., 1GL, 2GL, 3GL, 4GL, or 5GL) such as, for example, machine language that may be directly executed by the processor, or assembly language, object-oriented programming (OOP), scripting languages, microcode, etc., that may be compiled or assembled into machine readable instructions and stored on the memory module 232. Alternatively, the machine readable instructions may be written in a hardware description language (HDL), such as logic implemented via either a field-programmable gate array (FPGA) configuration or an application-specific integrated circuit (ASIC), or their equivalents. Accordingly, the functionality described herein may be implemented in any conventional computer programming language, as pre-programmed hardware elements, or as a combination of hardware and software components.

Still referring to FIG. 3, the network interface hardware 236 is coupled to the communication path 240 and communicatively coupled to the processor 234. The network interface hardware 236 may be any device capable of transmitting and/or receiving data via a network. Accordingly, the network interface hardware 236 can include a communication transceiver for sending and/or receiving any wired or wireless communication. For example, the network interface hardware 236 may include an antenna, a modem, LAN port, Wi-Fi card, WiMax card, mobile communications hardware, near-field communication hardware, satellite communication hardware and/or any wired or wireless hardware for communicating with other networks and/or devices. In some embodiments, the network interface hardware 236 includes hardware configured to operate in accordance with the Bluetooth® wireless communication protocol. In some embodiments, the network interface hardware 236 may be a wireless communication module configured to transmit and/or receive wireless signals according to the Bluetooth® 4.0 communication protocol. In such embodiments, the network interface hardware 236 may transmit and receive signals using less energy than other less energy efficient wireless communication protocols. However, in some embodiments the network interface hardware 236 is configured to transmit and/or receive wireless signals in accordance with a wireless communication protocol other than the Bluetooth® 4.0 communication protocol.

Still referring to FIG. 3, the speaker 220 is coupled to the communication path 240 and communicatively coupled to the processor 234. The speaker 220 is a transducer that transforms an electronic signal into acoustic energy. The speaker 220 may be used to output target hit information, as described below.

Still referring to FIG. 3, the plurality of light emitting diodes 250 is coupled to the communication path 240 and communicatively coupled to the processor 234. In some embodiments, the plurality of light emitting diodes 250 are coupled to pins of the electronic control unit 216. Some embodiments may include at least one light emitting diode having a dominant wavelength of 640 nm, which may allow the light emitting diode to detect light emitted by a red light emitting diode (e.g., outputting light at a wavelength of about 640 nm or about 635 nm) of the firearm simulator or a green light emitting diode (e.g., outputting light at a wavelength of about 535 nm) of the firearm simulator. In some embodiments, each of the plurality of light emitting diodes 250 are substantially the same, while in other embodiments one or more of the plurality of light emitting diodes 250 may be different from another of the plurality of light emitting diodes. 250.

Figure 4:
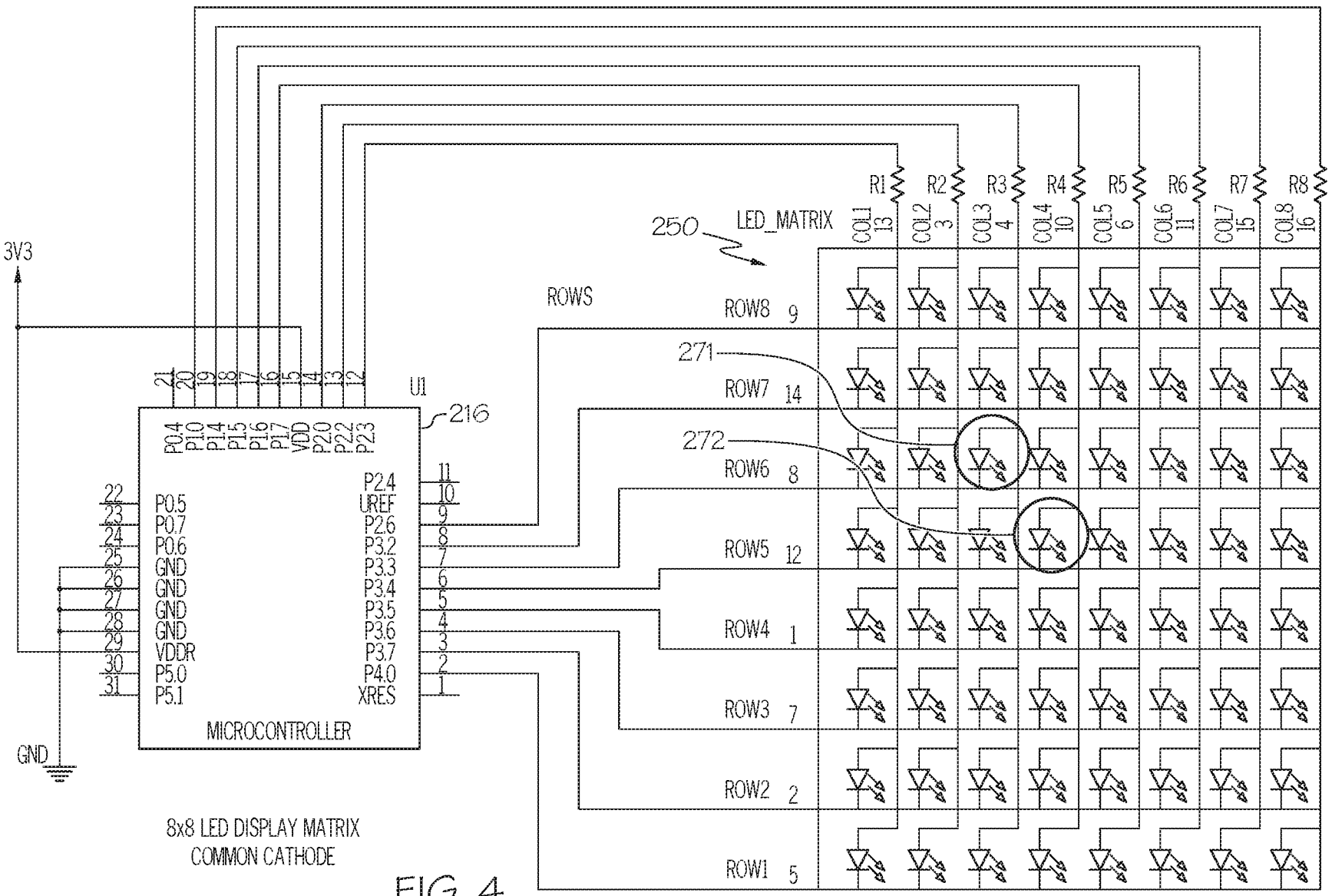
FIG. 4 schematically depicts another diagram of various electronic components of the firearm simulator target of FIG. 1, according to one or more embodiments shown and described herein.

Referring now to FIG. 4, a circuit schematic of the electronic components of the firearm simulator target is schematically depicted. The plurality of light emitting diodes 250 is communicatively coupled to the electronic control unit 216. As shown in FIG. 4, the plurality of light emitting diodes 250 are arranged in a light emitting diode matrix such that the plurality of light emitting diodes 250 are arranged in a plurality of columns of light emitting diodes and a plurality of rows of light emitting diodes. In some embodiments, the light emitting diode matrix may be a module in which the plurality of light emitting diodes 250 are prefabricated into a matrix configuration. In some embodiments, the plurality of light emitting diodes 250 are arranged in a configuration other than a matrix, such as in embodiments in which the plurality of light emitting diodes 250 are arranged in concentric circles, in rows and columns where the number of rows is different than the number of columns, in an asymmetric configuration, etc.

Still referring to FIG. 4, the plurality of rows of light emitting diodes includes a first row of light emitting diodes (ROW1), a second row of light emitting diodes (ROW2), a third row of light emitting diodes (ROW3), a fourth row of light emitting diodes (ROW4), a fifth row of light emitting diodes (ROW5), a sixth row of light emitting diodes (ROW6), a seventh row of light emitting diodes (ROW7), and an eight row of light emitting diodes (ROW8). The plurality of columns of light emitting diodes includes a first column of light emitting diodes (COL1), a second column of light emitting diodes (COL2), a third column of light emitting diodes (COL3), a fourth column of light emitting diodes (COL4), a fifth column of light emitting diodes (COL5), a sixth column of light emitting diodes (COL6), a seventh column of light emitting diodes (COL7), and an eight column of light emitting diodes (COL8). In some embodiments, the plurality of rows of light emitting diodes may include less than eight or more than eight rows. In some embodiments, the plurality of light emitting diodes may include less than eight or more than eight columns. In some embodiments, the number of rows of light emitting diodes may be different than the number of columns of light emitting diodes.

Still referring to FIG. 4, each of the plurality of rows of light emitting diodes and each of the plurality of columns of light emitting diodes is electrically coupled to a respective input/output pin of the electronic control unit 216. Resistors R1-R8 are disposed between each of the plurality of columns of light emitting diodes and the respective input/output pin of the electronic control unit 216 to which each of the plurality of columns of light emitting diodes is electrically connected. While FIG. 4 depicts a common cathode arrangement for the plurality of light emitting diodes 250, other embodiments may employ a common anode arrangement for the plurality of light emitting diodes 250.

Still referring to FIG. 4, the plurality of light emitting diodes includes a first light emitting diode 271 and a second light emitting diode 272. The first light emitting diode 271 is associated with the sixth row of light emitting diodes (ROW6) and the third column of light emitting diodes (COL3). The second light emitting diode 272 is associated with the fifth row of light emitting diodes (ROW5) and the fourth columns of light emitting diodes (COL4).

Having described the components of the firearm simulator 100, the firearm simulator target 200, and the computing device 300, various functions of the firearm simulator 100, the firearm simulator target 200, and the computing device 300 will now be described.

In some embodiments, each of the functions of the firearm simulator target 200 described below may be implemented as machine readable instructions stored in the memory module of the firearm simulator target 200 that, when executed by the processor of the firearm simulator target 200, automatically cause the firearm simulator target 200 to perform the steps described. In other embodiments, one or more of the functions of the firearm simulator target 200 described below may be implemented as machine readable instructions stored in a memory module of a computing device (e.g., the firearm simulator 100 and/or the computing device 300) that, when executed by a processor, automatically cause the firearm simulator target 200 to perform the steps described herein. In some embodiments, the machine readable instructions that cause the firearm simulator target 200 to perform the functions described below may be distributed among the firearm simulator target 200 and one or more computing devices (e.g., the firearm simulator 100 and/or the computing device 300).

In some embodiments, each of the functions of the firearm simulator 100 described below may be implemented as machine readable instructions stored in the memory module of the firearm simulator 100 that, when executed by the processor of the firearm simulator 100, automatically cause the firearm simulator 100 to perform the steps described. In other embodiments, one or more of the functions of the firearm simulator 100 described below may be implemented as machine readable instructions stored in a memory module of a computing device (e.g., the firearm simulator target 200 and/or the computing device 300) that, when executed by a processor, automatically cause the firearm simulator 100 to perform the steps described herein. In some embodiments, the machine readable instructions that cause the firearm simulator 100 to perform the functions described below may be distributed among the firearm simulator 100 and one or more computing devices (e.g., the firearm simulator target 200 and/or the computing device 300).

In some embodiments, each of the functions of the computing device 300 described below may be implemented as machine readable instructions stored in the memory module of the computing device 300 that, when executed by the processor of the computing device 300, automatically cause the computing device 300 to perform the steps described. In other embodiments, one or more of the functions of the computing device 300 described below may be implemented as machine readable instructions stored in a memory module of a computing device (e.g., the firearm simulator target 200 and/or the firearm simulator 100) that, when executed by a processor, automatically cause the computing device 300 to perform the steps described herein. In some embodiments, the machine readable instructions that cause the computing device 300 to perform the functions described below may be distributed among the computing device 300 and one or more computing devices (e.g., the firearm simulator target 200 and/or the firearm simulator 100).

While the methods described below include steps executed according to a specific sequence, other embodiments of the present disclosure may execute the steps in other sequences.

Figure 5:
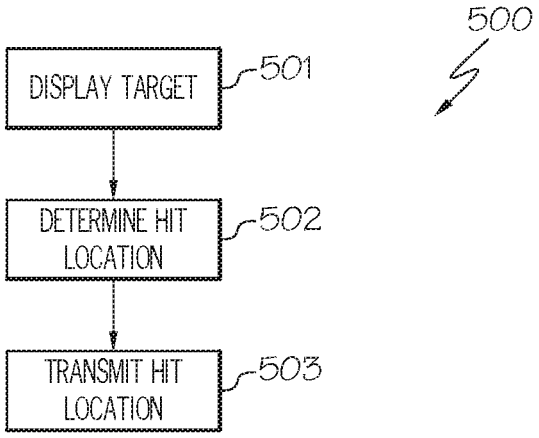
FIG. 5 schematically depicts a flowchart of a method of operating the firearm simulator target, according to one or more embodiments shown and described herein.

Referring now to FIG. 5 in conjunction with FIGS. 1-4, a flowchart of a method 500 of operating the firearm simulator target 200 is depicted. Before the method of FIG. 5 is executed, in some embodiments, the firearm simulator target 200 may execute initialization instructions to initialize hardware components and timers, initialize the plurality of light emitting diodes 250 and turn all light emitting diodes 250 to the off state, read and store the average ambient light levels detected by the columns of the light emitting diode matrix, establish a connection with the computing device.

At step 501, the firearm simulator target 200 displays a target pattern. In some embodiments, a target pattern subset of the plurality of light emitting diodes 250 is illuminated such that the illuminated target pattern subset of the plurality of light emitting diodes 250 displays the target pattern (e.g., a bullseye, a circle, a square, a point, an "x", a silhouette of a human, etc.). In some embodiments, the firearm simulator target 200 is configured to display a range of target patterns designed to simulate a wide variety of shooting disciplines and lead the shooter through various courses of fire. In some embodiments, the target pattern subset of the plurality of light emitting diodes 250 that are illuminated includes the first light emitting diode 271 such that the first light emitting diode 271 along with other light emitting diodes of the plurality of light emitting diodes 250 displays the target pattern. In some embodiments, the target pattern subset of the plurality of light emitting diodes 250 that are illuminated includes the second light emitting diode 272 such that the second light emitting diode 272 along with other light emitting diodes of the plurality of light emitting diodes 250 displays the target pattern. In some embodiments, the firearm simulator target 200 receives (e.g., via the network interface hardware 236) a message including the target pattern (e.g., a message sent by the computing device 300 or the firearm simulator 100) as an encoded bitmap and illuminates the target pattern subset of the plurality of light emitting diodes 250 to display the target pattern of the received message. In some embodiments, the target pattern displayed by the plurality of light emitting diodes 250 changes dynamically during a course of fire.

Still referring to FIG. 5, at step 502, the firearm simulator target 200 detects a hit location. In some embodiments, the firearm simulator target 200 detects the target hit location based on a signal received from at least one of the plurality of light emitting diodes 250 in response to light produced by the optoelectronic output device 124 of the firearm simulator 100. The signal received from the light emitting diode may be processed in a number of ways in order to determine the target hit location. In some embodiments, the target hit location may be determined by measuring a voltage across the light emitting diode and determining the target hit location as the light emitting diode based on a comparison of the measured voltage and a threshold voltage (e.g., a hit location at the light emitting diode is determined when the measured voltage exceeds the threshold voltage or is less than the threshold voltage). In some embodiments, the target hit location may be determined by measuring a time required for a voltage across the light emitting diode to drop a certain amount or to a certain level and determining the target hit location as the light emitting diode based on the time (e.g., a hit location at the light emitting diode is determined when the time exceeds a threshold or is less than a threshold). In some embodiments, a voltage may be applied across the light emitting diode (e.g. by reverse biasing the light emitting diode), the voltage across the light emitting diode may be discharged, a time to discharge the voltage across the light emitting diode may be determined, and the target hit location may be determined at the light emitting diode based on the time to discharge the voltage across the light emitting diode.

Non-limiting concrete examples of these hit determination methodologies be provided in the context of determining a hit location at the first light emitting diode 271 to provide further explanation of possible implementations of step 502 of FIG. 5. For example, the firearm simulator target 200 may receive a signal from the first light emitting diode 271 and determine the target hit location as the first light emitting diode 271 based on the signal received from the first light emitting diode 271. In some embodiments, the target hit location is determined as the first light emitting diode 271 by measuring a voltage across the first light emitting diode 271 and determining the target hit location as the first light emitting diode 271 based on a comparison of the measured voltage and a threshold voltage (e.g., a hit location at the first light emitting diode 271 is determined when the measured voltage exceeds the threshold voltage or is less than the threshold voltage). In some embodiments, the target hit location is determined as the first light emitting diode 271 by measuring a time required for a voltage across the first light emitting diode 271 to drop a certain amount or to a certain level and determining the target hit location as the first light emitting diode 271 based on the time (e.g., a hit location at the first light emitting diode 271 is determined when the time exceeds a threshold or is less than a threshold). In some embodiments, a voltage may be applied across the first light emitting diode 271 (e.g. by reverse biasing the first light emitting diode 271), the voltage across the first light emitting diode 271 may be discharged, a time to discharge the voltage across the first light emitting diode 271 may be determined, and the target hit location may be determined at the first light emitting diode 271 based on the time to discharge the voltage across the first light emitting diode 271.

Still referring to step 502 of FIG. 5, in some embodiments in which the plurality of light emitting diodes 250 are arranged in a light emitting diode matrix including a plurality of rows of light emitting diodes and a plurality of columns of light emitting diodes (e.g., as shown in FIG. 4), the target hit location may be determined by determining at least one of a row hit location and a column hit location and determining the target hit location based on the determined at least one of the row hit location and the column hit location. In some embodiments, the firearm simulator target 200 measures at least one of a row voltage across a row of light emitting diodes and a column voltage across a first column of light emitting diodes, determine at least one of a row hit location and a column hit location based on the at least one of the row voltage across the row of light emitting diodes and the column voltage across the column of light emitting diodes, and determines the target hit location based on the determined at least one of the row hit location and the column hit location. For example, in some embodiments, the firearm simulator target 200 measures a row voltage across a row of light emitting diodes, determines the row of light emitting diodes as a row hit location based on the measured row voltage (e.g., by comparing the row voltage to a threshold row voltage and determining the row of light emitting diodes as the row hit location based on the comparison), measures a column voltage across a column of light emitting diodes, determines the column of light emitting diodes as a column hit location based on the measured column voltage (e.g., by comparing the column voltage to a threshold column voltage and determining the column of light emitting diodes as the column hit location based on the comparison), and determines the target hit location as the light emitting diode based on the row hit location and the column hit location.

Still referring to step 502 of FIG. 5, in some embodiments in which the plurality of light emitting diodes 250 are arranged in a light emitting diode matrix including a plurality of rows of light emitting diodes and a plurality of columns of light emitting diodes (e.g., as shown in FIG. 4), the firearm simulator target 200 reverse biases a row of light emitting diodes to apply a voltage across the row of light emitting diodes, discharges the voltage across the row of light emitting diodes, determines a time to discharge the voltage across the row of light emitting diodes (e.g., the time to discharge to a threshold voltage), determines the row of light emitting diodes as a row hit location based on the time to discharge the voltage across the row of light emitting diodes, determines a voltage across a column of light emitting diodes, determines the column of light emitting diodes as a column hit location based on the voltage across the column of light emitting diodes (e.g., by comparing the voltage across the column of light emitting diodes to a threshold voltage), and determines the target hit location as the light emitting diode based on the row hit location and the column hit location (e.g., by determining the target hit location as the row hit location and the column hit location).

Still referring to step 502 of FIG. 5, in some embodiments in which the plurality of light emitting diodes 250 are arranged in a light emitting diode matrix including a plurality of rows of light emitting diodes and a plurality of columns of light emitting diodes (e.g., as shown in FIG. 4), the firearm simulator target 200 reverse biases a column of light emitting diodes to apply a voltage across the column of light emitting diodes, discharges the voltage across the column of light emitting diodes, determines a time to discharge the voltage across the column of light emitting diodes (e.g., the time to discharge to a threshold voltage), determines the column of light emitting diodes as a column hit location based on the time to discharge the voltage across the column of light emitting diodes, determines a voltage across a row of light emitting diodes, determines the row of light emitting diodes as a row hit location based on the voltage across the row of light emitting diode (e.g., by comparing the voltage across the row of light emitting diodes to a threshold voltage), and determines the target hit location as the light emitting diode based on the row hit location and the column hit location (e.g., by determining the target hit location as the row hit location and the column hit location).

Further non-limiting concrete examples of these hit determination methodologies are provided in the context of determining a hit location at the first light emitting diode 271 to provide further explanation of possible implementations of step 502 of FIG. 5. In some embodiments, the firearm simulator target 200 reverse biases the sixth row of light emitting diodes (ROW6) to apply a voltage across the sixth row of light emitting diodes (ROW6), discharges the voltage across the sixth row of light emitting diodes (ROW6), determines a time to discharge the voltage across the sixth row of light emitting diodes (ROW6) (e.g., the time to discharge to a threshold voltage), determines the sixth row of light emitting diodes (ROW6) as a row hit location based on the time to discharge the voltage across the sixth row of light emitting diodes (ROW6), determines a voltage across the third column of light emitting diodes (COL3), determines the third column of light emitting diodes (COL3) as a column hit location based on the voltage across the third column of light emitting diodes (COL3) (e.g., by comparing the voltage across the third column of light emitting diodes (COL3) to a threshold voltage), and determines the target hit location as the first light emitting diode 271 based on the row hit location and the column hit location (e.g., by determining the target hit location as ROW6, COL3).

Still referring to step 502 of FIG. 5, in some embodiments in which the plurality of light emitting diodes 250 are arranged in a light emitting diode matrix including a plurality of rows of light emitting diodes and a plurality of columns of light emitting diodes (e.g., as shown in FIG. 4), the firearm simulator target 200 reverse biases the third column of light emitting diodes (COL3) to apply a voltage across the third column of light emitting diodes (COL3), discharges the voltage across the third column of light emitting diodes (COL3), determines a time to discharge the voltage across the third column of light emitting diodes (COL3) (e.g., the time to discharge to a threshold voltage), determines the third column of light emitting diodes (COL3) as a column hit location based on the time to discharge the voltage across the third column of light emitting diodes (COL3), determines a voltage across the sixth row of light emitting diodes (ROW6), determines the sixth row of light emitting diodes as a row hit location based on the voltage across the sixth row of light emitting diodes (ROW6) (e.g., by comparing the voltage across the sixth row of light emitting diodes (ROW6) to a threshold voltage), and determines the target hit location as the first light emitting diode 271 based on the row hit location and the column hit location (e.g., by determining the target hit location as ROW6, COL3).

Still referring to step 502 of FIG. 5, in some embodiments the firearm simulator target 200 determines the target hit location based on an ambient light level. For example, in some embodiments, the firearm simulator target 200 receives at least one ambient light level signal from one or more of the plurality of light emitting diodes 250 (e.g., the first light emitting diode 271, the second light emitting diode 272, and/or one of the other light emitting diodes of the plurality of light emitting diodes 250), determines an ambient light level based on the received at least one ambient light level signal, and determines the target hit location based on the ambient light level and the signal received from at least one of the plurality of light emitting diodes 250. In some embodiments, the ambient light level may be determined based on ambient light level signals received from one or more of the plurality of light emitting diodes 250 at different times (e.g., by averaging ambient light level signals received at different times). In some embodiments, the ambient light level may be determined based on ambient light level signals received from multiple light emitting diodes of the plurality of light emitting diodes 250 (e.g., by averaging ambient light level signals received from multiple light emitting diodes of the plurality of light emitting diodes 250). In some embodiments, the target hit location may be determined based on the ambient light level by adjusting a threshold voltage (e.g., any of the threshold voltages described above or below) used to determine a target hit location based on the ambient light level and/or by adjusting a time used to determine a target hit location (e.g., the time to discharge a voltage across the light emitting diode).

Further details with respect to algorithms that may be employed to detect hit locations are described in the following in conjunction with the circuit schematic of FIG. 4 and FIGS. 8-12.

Figure 8:
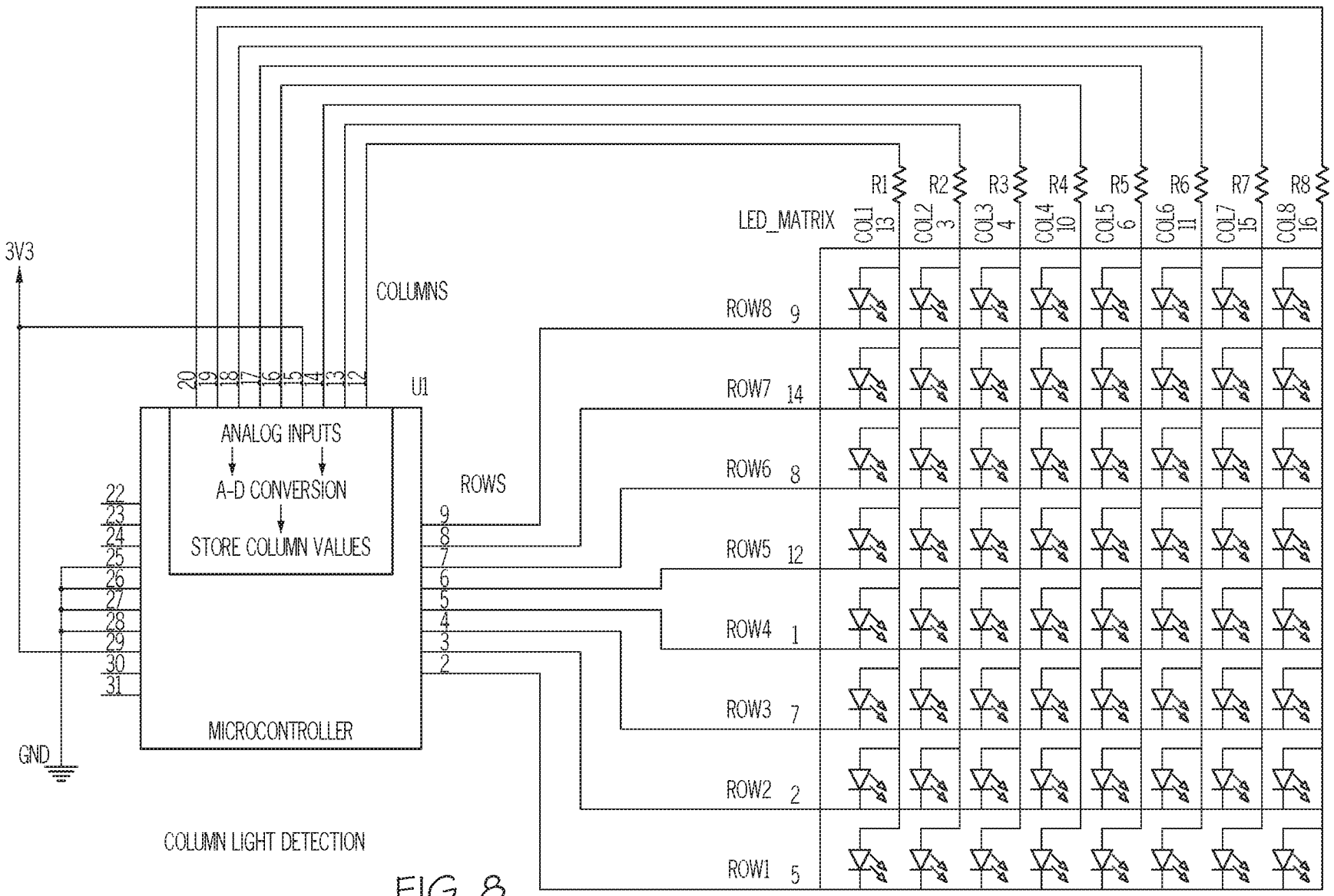
FIG. 8 schematically depicts a configuration for column light detection, according to one more embodiments shown and described herein.

In some embodiments, column light detection is achieved by 1) bringing all light emitting diode anodes and cathodes low, then 2) successively changing each column's I/O pin to a high impedance analog input mode and measuring the voltage across the light emitting diode junctions using an analog-to-digital converter, and 3) storing each column's value for comparison against ambient levels (FIG. 8). If a light emitting diode in a column is being exposed to light whose wavelength is the same as or shorter than the dominant wavelength emitted by the light emitting diode, then the measured voltage will be higher than normal. If the difference between that value and the stored ambient light value is above a given threshold, then it is assumed the column is being impacted by laser light.

Figure 9:
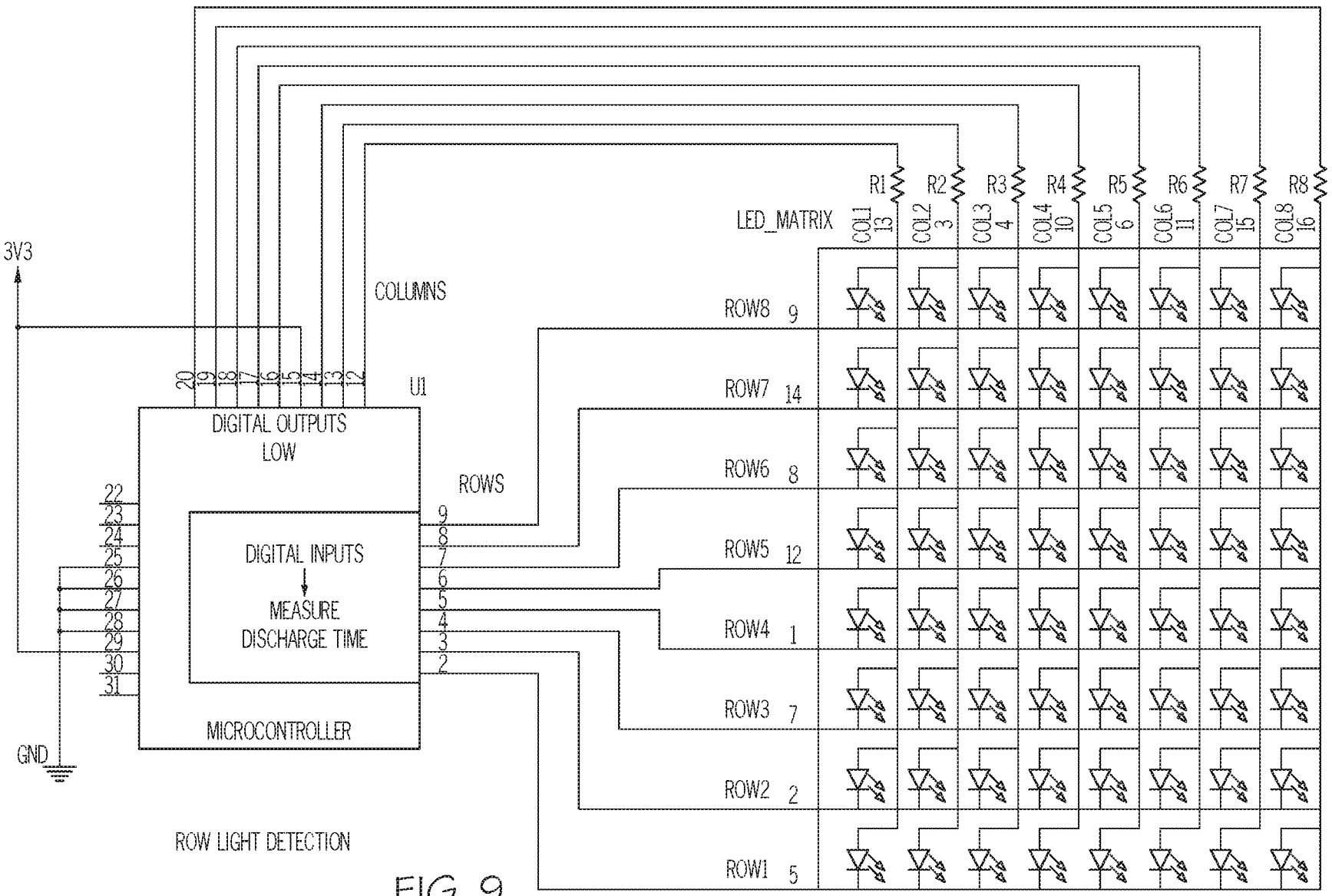
FIG. 9 schematically depicts a configuration for row light detection, according to one more embodiments shown and described herein.

In some embodiments, row light detection is achieved by 1) raising all row digital I/O pins driving the light emitting diode cathodes high (applied voltage) while bringing all column digital I/O pins driving the light emitting diode anodes low (connected to ground), thereby reverse-biasing the light emitting diode, then 2) changing all row digital I/O pins to inputs, and 3) measuring the time it takes for each row input to reach a low level, indicating that the light emitting diode has discharged the voltage it stored while reversed-biased (FIG. 9). If a light emitting diode in a row is being exposed to light whose wavelength is the same as or shorter than the dominant wavelength emitted by the light emitting diode, then the discharge time will be faster than normal. If the time is faster than a given threshold, then it is assumed the row is being impacted by laser light.

Figure 6:
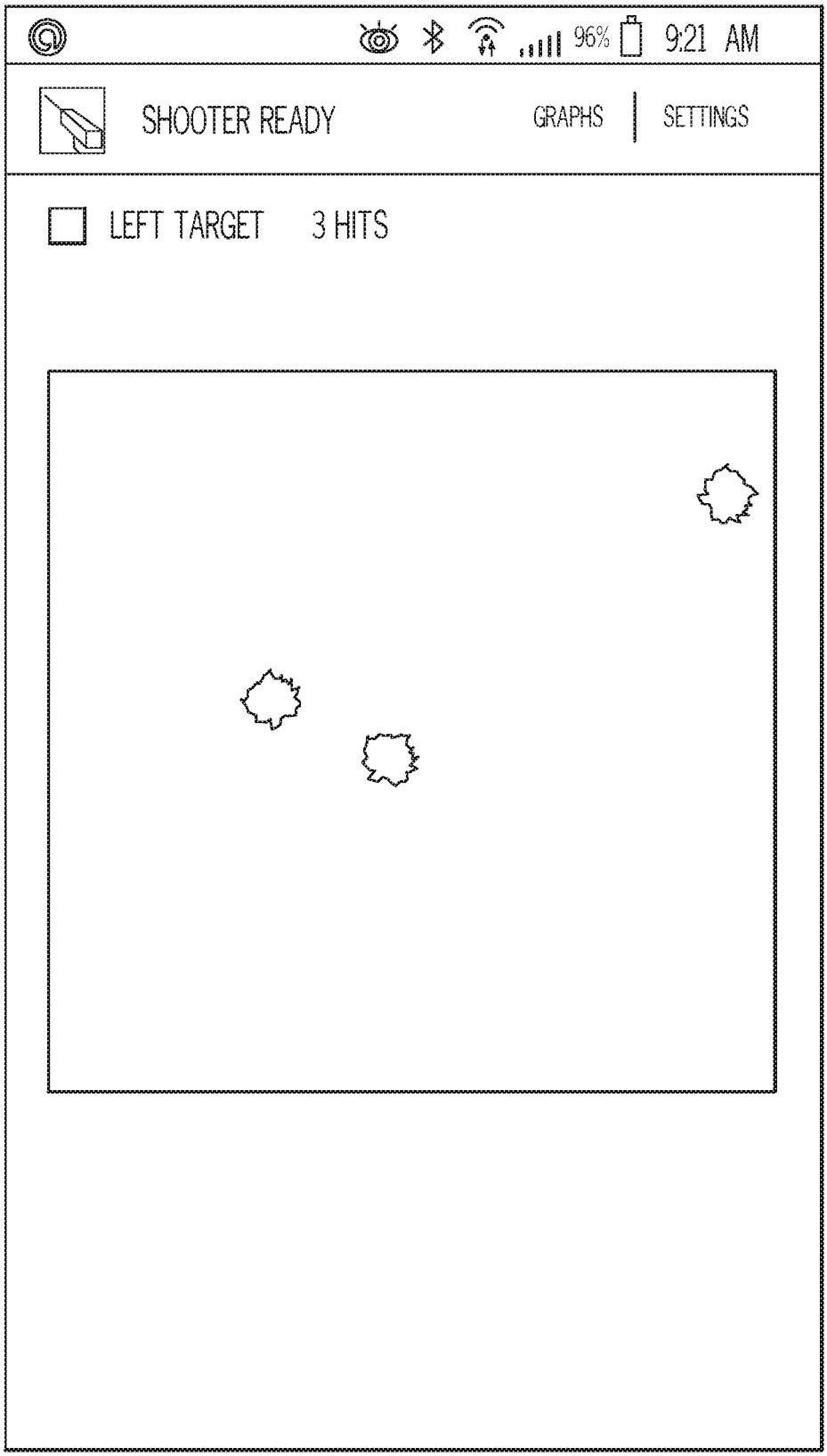
FIG. 6 schematically depicts a graphical user interface displaying target hit locations, according to one or more embodiments shown and described herein.

If a column and a row are simultaneously detecting laser light, then it is determined that a hit is occurring on the target. The column and row numbers are sent to the app which indicates a hit to the shooter, shown on the shot timer screen as green for that shot, and displays the hit on a steel plate image representing the target (FIG. 6). For some courses of fire, the hit may be shown on the target itself, indicated by lighting the light emitting diode at the hit location.

Figure 10:
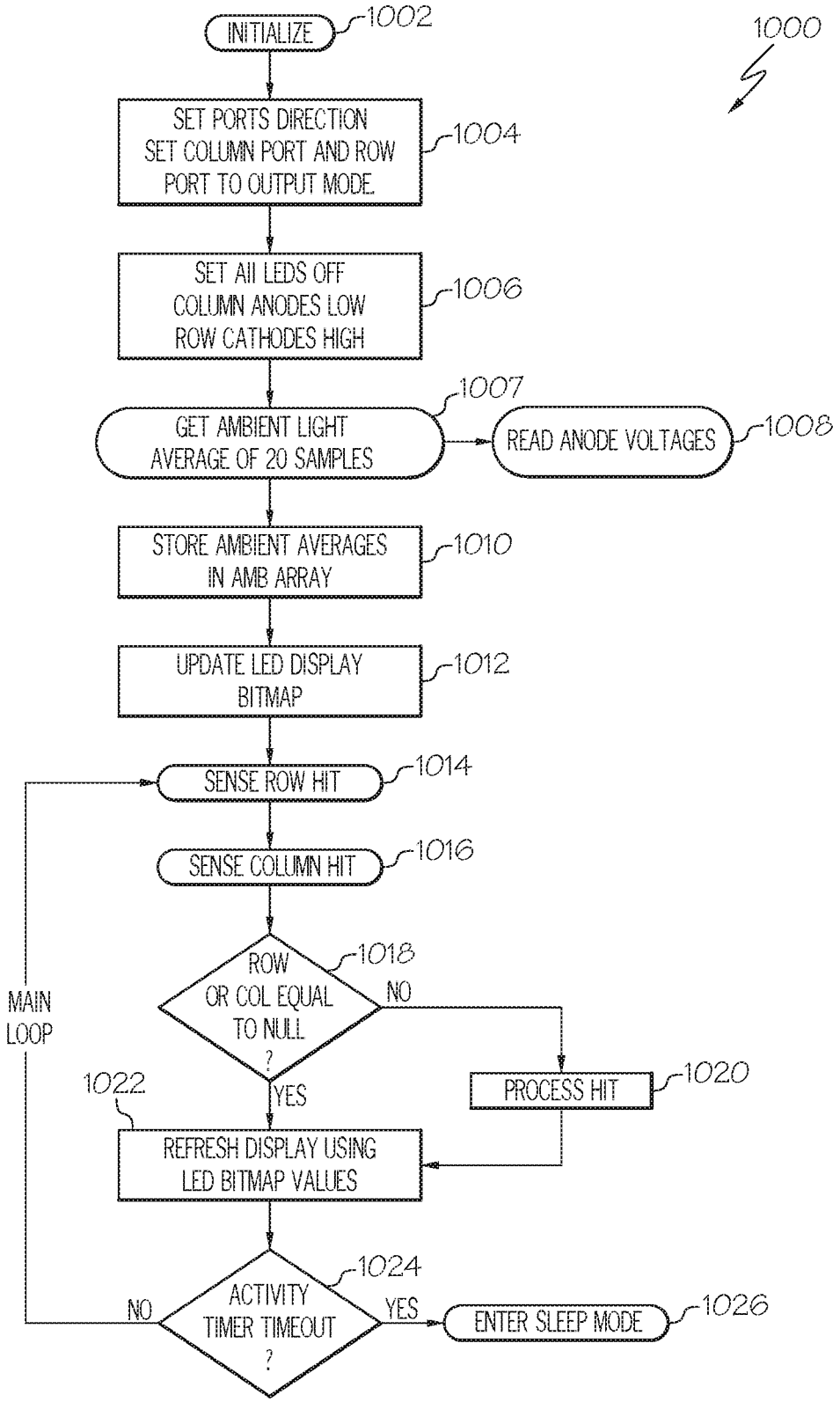
FIG. 10 schematically depicts a flowchart of a method of operating a firearm simulator target, according to one or more embodiments shown and described herein.
Figure 11:
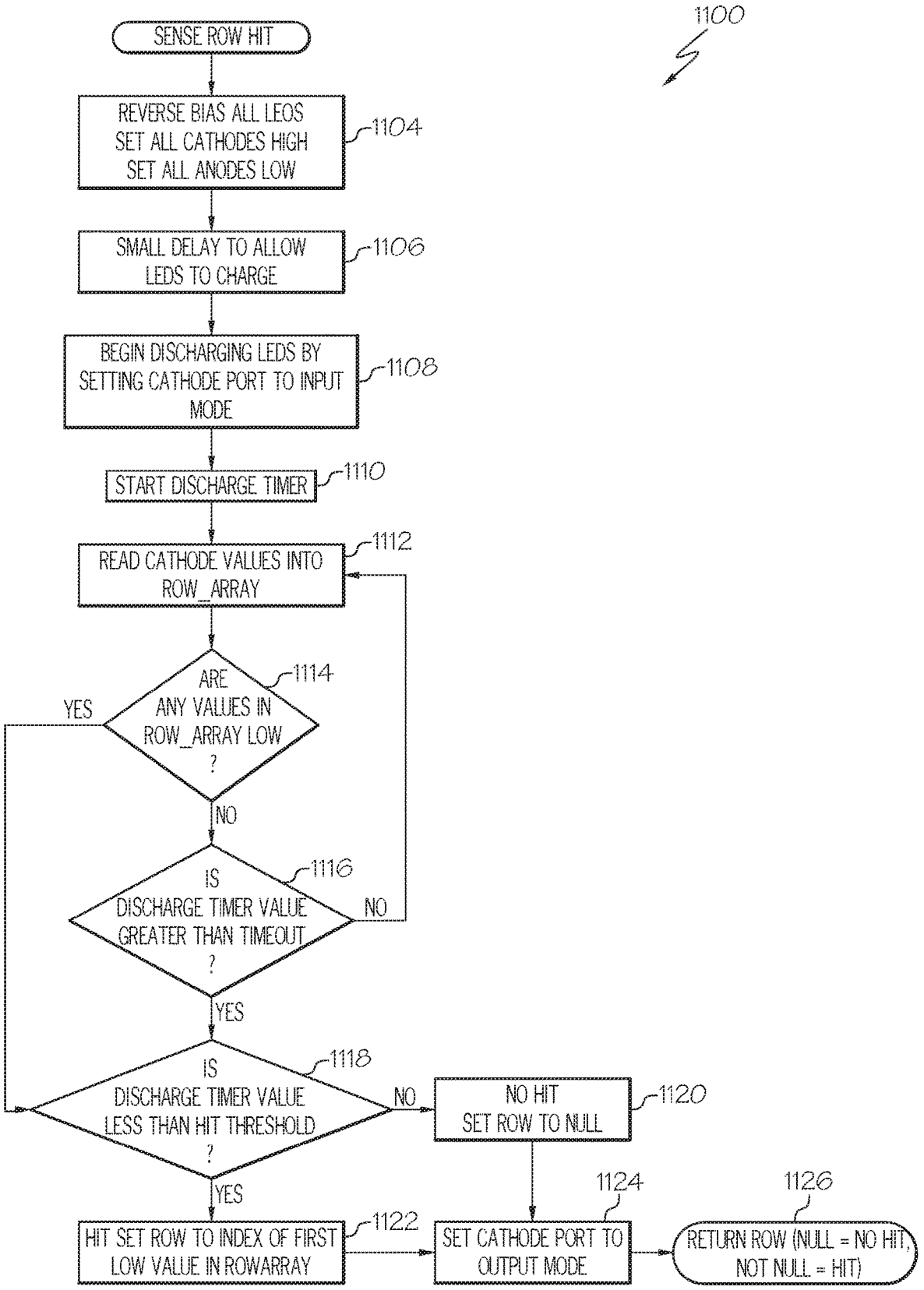
FIG. 11 schematically depicts a flowchart of a method of determining a row hit location, according to one or more embodiments shown and described herein.
Figure 12:
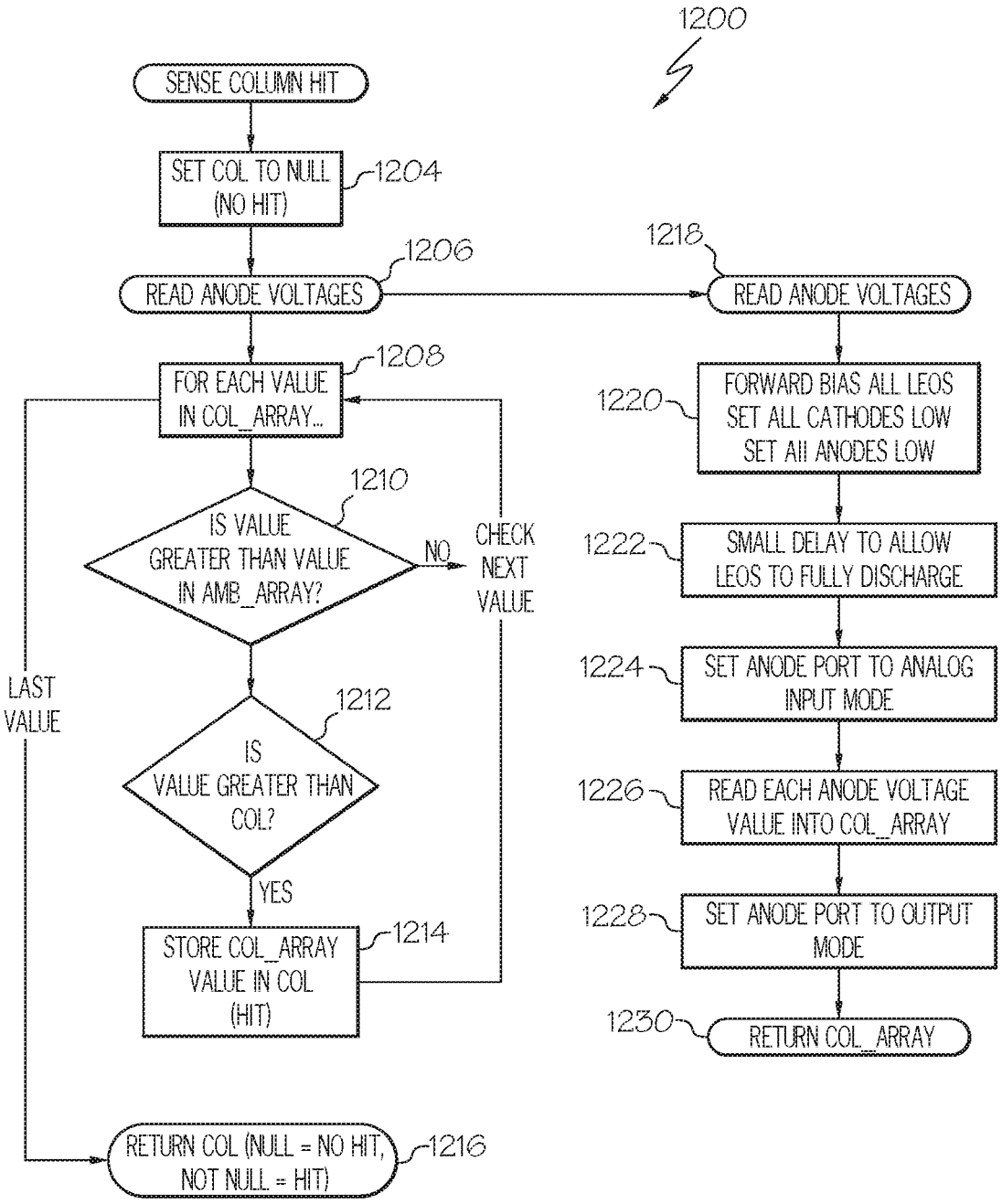
FIG. 12 schematically depicts a flowchart of a method of determining a column hit location, according to one or more embodiments shown and described herein.

FIGS. 10-12 depict additional flowcharts further illustrating the hit detection methods described herein.

FIG. 10 depicts a method 1000 of operating a firearm simulator target 200. The initialization of firearm simulator target 200 begins at step 1002 and continues through step 1012. At step 1002, an activity timer managed by processor 134 is initialized to increment by one each second. At step 1004, the direction of the column and row digital I/O ports of FIG. 4 are set to output mode. At step 1006, all column digital I/O pins driving the light emitting diode anodes of FIG. 4 are brought low (connected to ground), and all row digital I/O pins driving the light emitting diode cathodes of FIG. 4 are brought high (applied voltage), thereby reverse-biasing the light emitting diodes. Step 1007 calculates the average value of multiple analog-to-digital conversion samples of each of the column I/O port pins, whereby the values indicate the voltage present at each of the column anodes of the plurality of light emitting diodes of FIG. 8 while exposed to ambient light. At step 1008, the column analog voltages are read, such as depicted in steps 1218-1230 of FIG. 12. Referring to steps 1218-1230 of FIG. 12, at step 1220, all row digital I/O pins connected to the cathodes of the plurality of light emitting diodes of FIG. 8 are brought low (connected to ground) and all column digital I/O pins connected to the light emitting diode anodes of FIG. 8 are brought low (connected to ground). At step 1222, this state is held for a short time allowing the light emitting diodes to fully discharge any stored voltage. At step 1224, the column I/O port is set to analog input mode as depicted in FIG. 8. At step 1226, each anode column of the plurality of light emitting diodes of FIG. 8 connected to an analog input column pin is read and the voltage present is converted to a digital value using analog-to-digital conversion and stored in an array that is returned in step 1230 after setting the light emitting diode anode column port back to output mode in step 1228.

Referring again to FIG. 10, step 1010 stores the average of the multiple samples of each of the column I/O port pins representing the voltage present at each of the column anodes of the light emitting diodes of FIG. 8 when exposed to ambient light, such that they may be referenced for comparison using a threshold to determine a column hit location as depicted in FIG. 12.

Still referring to FIG. 10, at step 1012, a bitmap array in memory is updated with a target pattern, where each bit of the bitmap array corresponds to one of the light emitting diodes in the plurality of light emitting diodes 250 and are illuminated if the associated bit within the bitmap is set, such that the illuminated target pattern subset of the plurality of light emitting diodes 250 displays the target pattern.

Still referring to FIG. 10, at step 1014, method 1100 depicted in FIG. 11 for row hit detection is performed, as will be described in detail below. At step 1016, method 1200 depicted in FIG. 12 for column hit detection is performed, as will be described in detail below. At step 1018, the results of the row and column hit detection are evaluated. If a hit is detected on both a row and a column (result is NOT NULL for both) then at step 1020, the target hit location is sent to computing device 300 and the activity timer is reset, then step 1022 is performed. If either row or column hit detection results in no hit (result is NULL for either), then step 1022 is performed. At step 1022, the target display is refreshed by illuminating the light emitting diodes in the plurality of light emitting diodes 250 if the associated bit within the bitmap is set, such that the illuminated target pattern subset of the plurality of light emitting diodes 250 displays the target pattern.

Still referring to FIG. 10, at step 1024 the activity timer accumulation register is evaluated to see if its value is greater than an arbitrary timeout value. If it is greater, the processor 134 enters sleep mode to conserve battery power at step 1026. If the value of the activity timeout register is less than the timeout value (NO at step 1024), then method 1100 of FIG. 11 for row hit detection is performed, continuing the MAIN LOOP of FIG. 10 from the beginning.

FIG. 11 depicts a method 1100 of sensing a row hit. If a light emitting diode in a row is being exposed to light whose wavelength is the same as or shorter than the dominant wavelength emitted by the light emitting diode, then the light emitting diode's discharge time will be faster than normal. If the time is faster than a given threshold, then it is assumed the row is being impacted by laser light.

At step 1104, the direction of the column and row digital I/O ports of FIG. 9 are set to output mode and all row digital I/O pins driving the light emitting diode cathodes of FIG. 9 are brought high (applied voltage) and all column digital I/O pins driving the light emitting diode anodes of FIG. 9 are brought low (connected to ground), thereby reverse-biasing the light emitting diodes to store a charge in the light emitting diode's intrinsic capacitance. At step 1106, this state is held for a short time allowing the light emitting diode's intrinsic capacitance to fully charge. At step 1108, the direction of the row digital I/O port of FIG. 9 is set to input mode, allowing a path to ground for the light emitting diodes to begin discharging. At step 1110, a timer is started to measure the amount of time taken for any of the row input pins to discharge sufficiently to reach a low state (brought to ground).

Still referring to FIG. 11, the row inputs of FIG. 9 are read into an array at step 1112 and at step 1114 each are evaluated for a low state (brought to ground). If a row input is found to be at a low state, the light emitting diode associated with that row is considered to be discharged. At step 1118, the amount of time to discharge is evaluated to determine if it is less (faster) than a given threshold. At step 1122, the row number is saved so it can be returned as a HIT at step 1126 after the row digital I/O port of FIG. 9 is set back to output mode in step 1124. If none of the rows are found to discharge to a low state (brought to ground) within a given timeout at step 1116 or in step 1118, then the row number is set to NULL and returned at step 1126 as NO HIT after the row digital I/O port is set back to output mode in step 1124.

FIG. 12 depicts a method 1200 of sensing a column hit. If a light emitting diode in a column is being exposed to light whose wavelength is the same as or shorter than the dominant wavelength emitted by the light emitting diode, then the light emitting diode's measured voltage will be higher than normal. If the difference between that value and the stored ambient light value is above a given threshold, then it is assumed the column is being impacted by laser light.

At step 1204, variable COL is used to store data for column hit detection and is initialized to NULL (no hit). At step 1206, the average value of multiple analog-to-digital conversion samples is calculated for each of the column I/O port pins, whereby the values indicate the voltage present at each of the column anodes of the plurality of light emitting diodes of FIG. 8. Step 1206 references the reading of column analog voltages as depicted beginning at step 1218 of FIG. 12. At step 1220, all row digital I/O pins connected to the cathodes of the plurality of light emitting diodes of FIG. 8 are brought low (connected to ground) and all column digital I/O pins connected to the light emitting diode anodes of FIG. 8 are brought low (connected to ground). At step 1222, this state is held for a short time allowing the light emitting diodes to fully discharge any stored voltage. At step 1224, the column I/O port is set to analog input mode as depicted in FIG. 8. At step 1226, each anode column of the plurality of light emitting diodes of FIG. 8 connected to an analog input column pin is read and the voltage present is converted to a digital value using analog-to-digital conversion and stored in an array at step 1226 that is returned in step 1230, after setting the light emitting diode anode column port back to output mode in step 1228.

Still referring to FIG. 12, at steps 1208 and 1210 each column anode value captured in step 1206 is compared to the stored ambient light averages captured in step 1010 of FIG. 10. If the column anode value is less than the sum of the stored ambient light average for the corresponding anode column and a given threshold value, then it is assumed no hit occurred on that column and the next column anode value is evaluated. If the column anode value is greater than the sum of the stored ambient light average and the given threshold value, then at step 1212 a second evaluation is performed to see if that column anode value is greater than the previous value stored in variable COL. If the analog value is greater than the value stored in variable COL, then that value replaces the value stored in variable COL, otherwise the value of variable COL remains unchanged.

Still referring to FIG. 12, after the last column anode value has been examined at step 1216 the column number represented by the value stored in variable COL (HIT), or NULL if a column hit was not detected (NO HIT), is returned.

In some embodiments, the firearm simulator target 200 may illuminate one or more of the plurality of light emitting diodes 250 in response to determining a target hit location. In some embodiments, the firearm simulator target 200 illuminates a light emitting diode of the plurality of light emitting diodes 250 in response to determining a target hit location at that light emitting diode. For example, in some embodiments, the firearm simulator target 200 illuminates the first light emitting diode 271 of the plurality of light emitting diodes 250 in response to determining a target hit location at the first light emitting diode 271. In some embodiments, the firearm simulator target 200 illuminates the second light emitting diode 272 of the plurality of light emitting diodes 250 in response to determining a target hit location at the second light emitting diode 272.

In some embodiments, the firearm simulator target 200 outputs a sound with the speaker 220 in response to the firearm simulator target 200 determining a target hit location. The firearm simulator target 200 may output other sounds with the speaker 220, such as instructions for performing firearm simulation exercises, and the like. For example, in some embodiments, the speaker 220 may output audible commands given by a range officer, the sound of gunshot rounds as the firearm simulator 100 is fired, the sounds of bullets hitting the target, or the like. In some embodiments, the sounds may be output by one or more speakers of the firearm simulator 100 and/or the computing device 300.

Still referring to FIG. 5, the firearm simulator target 200 transmits the target hit location at step 503. In some embodiments, the target hit location is transmitted from the firearm simulator target 200 via the network interface hardware 236 to the computing device 300. The computing device 300 may display a graphic indication of the target hit location on a graphical user interface (e.g., as shown in FIG. 6). In some embodiments, such as some embodiments in which the plurality of light emitting diodes 250 are arranged in a light emitting diode matrix, a message including the column of the light emitting diode determined as the target hit location and the row of the light emitting diode determined as the target hit location is transmitted via the network interface hardware 236 of the firearm simulator target 200 to the computing device 300 as the target hit location. In some embodiments, the target hit location may be transmitted in a coordinate system, as a light emitting diode identifier, a hit within a particular zone, etc.

Figure 7:
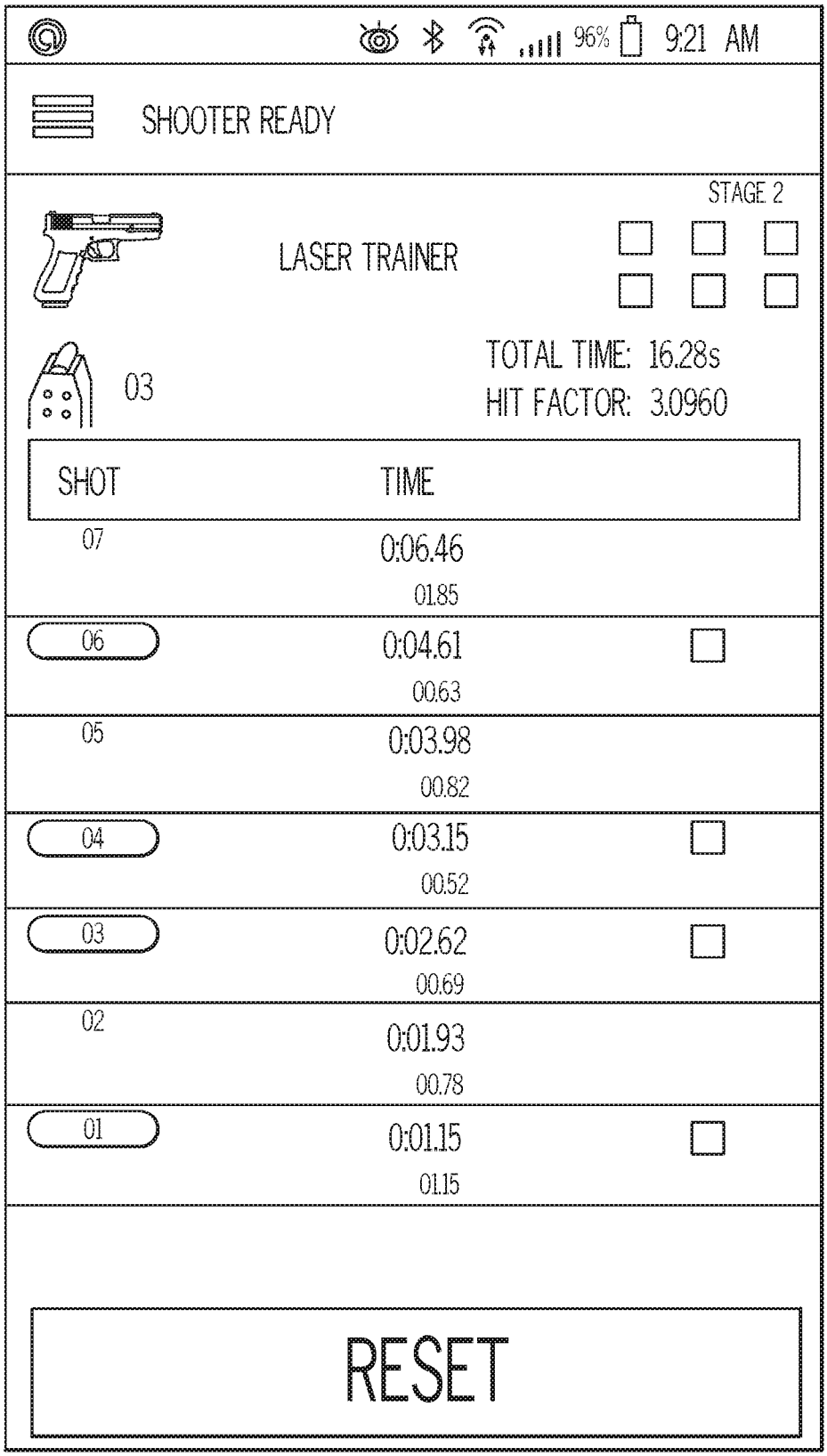
FIG. 7 schematically depicts a graphical user interface displaying statistics for multiple shots from a firearm simulator to a firearm simulator target, according to one or more embodiments shown and described herein.

Some embodiments may include only one firearm simulator target 200. Some embodiments may include a plurality of firearm simulator targets 200, which may be used together to significantly increase effectiveness of the training exercise. Embodiments that include a plurality of firearm simulator targets 200 may include targets placed at varying distances and angles from the shooter to provide a variety of shooting training exercises according to the shooter's abilities. Some embodiments may include a plurality of firearm simulator targets 200, each of which may be configured to receive light from the firearm simulator 100. In some embodiments, each of a plurality of firearm simulator targets 200 are communicatively coupled to the computing device 300 and configured to transmit a target hit location (e.g., via the network interface hardware of each of the plurality of firearm simulator targets 200) to the computing device 300. In some embodiments, the computing device 300 automatically connects to all firearm simulator targets within communication range. The computing device 300 may include an application that allows a user to choose from a variety of courses of fire to emulate shooting activities, such as target practice, defensive practice, bullseye, steel plate, practical pistol, and reactive shooting scenarios. The computing device 300 may receive target hit locations from each of the plurality of fire simulator targets 200 and display target hit locations from each of the plurality of firearm simulator targets on a single graphical user interface (e.g., in different colors for different targets), on multiple graphical user interfaces (e.g., one graphical user interface for each target), or in another manner. In some embodiments, the computing device 300 may display a graphical user interface showing a list of shots fired with the firearm simulator (e.g., based on messages received at the computing device 300 from the firearm simulator 100 when the firearm simulator 100 determines a shot has been fired based on the trigger output signal of the trigger unit 104), a time that the shot was fired, and a graphical indication distinguishing which of a plurality of firearm simulator targets was hit (e.g., based on messages received a the computing device 300 with target hit locations from the plurality of firearm simulator targets) (See FIG. 7). In some embodiments, the computing device 300 may display a shot timer, and/or may display cumulative and split times for successive shooting strings in various courses of fires. In some embodiments, the computing device 300 may display information related to timing of magazine changes (e.g., as described in U.S. patent application Ser. No. 14/969,842, filed Dec. 15, 2015 and entitled "FIREARM SIMULATORS," the entire contents of which are hereby incorporated by reference).

Further explanation of algorithms executed by the electronic control unit 216 of the firearm simulator target 200 will now be provided. These algorithms may be executed instead of, in addition to, or to complement any of the functionality described above, The electronic control unit 216 runs a continuous loop that determines if any data has been received from the computing device 300 (e.g., settings or target patterns), determines if laser light is detected on any of the plurality of rows of light emitting diodes (e.g., by reverse biasing each of the plurality of rows of light emitting diodes, then measuring the time it takes for each of the plurality of rows of light emitting diodes to discharge the stored voltage to a threshold voltage), determine if laser light is detected on any of the columns of light emitting diodes (e.g., by reading the amount of voltage across each of the columns of light emitting diodes, which will be relative the amount of light being received and comparing the voltages to stored ambient light values), determining a target hit location if laser light is detected on both an LED matrix row and column, transmitting the target hit location to the computing device 300, performing a scan to illuminate light emitting diodes of the plurality of light emitting diodes 250 to display the current target pattern received from the computing device 300, determine if activity has occurred during a predetermined period of time, enter sleep mode if there has been no activity within the predetermined period of time, and repeat the loop if activity has occurred during the predetermined period of time. In embodiments, the plurality of light emitting diodes 250 are multiplexed at a very high speed in order to illuminate the appropriate light emitting diodes in succession to display the target pattern, and turn off all of the plurality of light emitting diodes 250 in order to perform laser light hit detection. In some embodiments, the multiplexing rate is fast enough to minimize or eliminate noticeable flicker, giving the appearance to the shooter that the illuminated light emitting diodes comprising the target pattern are always on.

Not to be bound by theory, the firearm simulator targets described herein leverage several features of light emitting diodes. Light emitting diodes may emit light and sense light in a manner similar to a photo sensor. Using light emitting diodes as photo sensors takes advantage of a characteristic whereby incoming light with a wavelength at or slightly shorter than the wavelength of the light emitted by the light emitting diode (within a limited bandwidth) generates small amounts of current through the light emitting diode junction. The voltage across the junction is proportional to the amount of incoming light (e.g., the more light, the higher the voltage). When reverse-biased, a light emitting diode tends to store a small voltage, similar to a capacitor, which is then leaked (discharged) when the cathode is returned to ground potential. The rate of discharge is dependent on the amount of light incident on the light emitting diode junction (e.g., the more light, the faster the discharge occurs). These characteristic are rarely used in practical applications because light emitting diodes can only detect a very narrow band of wavelengths. However, the light emitting diodes of some embodiments of the firearm simulator targets described herein may work well to detect incidences of coherent laser light within a broad spectrum ambient light medium, because the lasers of the firearm simulators are very bright and emit light of a very specific wavelength. For example, red lasers commonly used in firearm simulators emit a wavelength of 640 nm or 635 nm, and green lasers emit a wavelength of around 535 nm. Light emitting diodes that have a dominant wavelength specified at 640 nm can be used to detect both of these quite easily by taking advantage of these characteristics.

The firearm simulation systems described herein include firearm simulators and firearm simulator targets that allow a shooter to perform dry fire exercises safely while receiving visual and audible feedback regarding shooting accuracy, timing, and control. Embodiments described herein may be used to provide a dry fire training experience with significantly enhanced simulations, adding feedback and realism to a much greater extent and with a lower expense than found in existing firearm training systems.

Embodiments of firearm simulator targets described herein that use the same light emitting diodes to display target patterns and sense target hits eliminate the need for discrete photo sensors for hit detection, which may increase the density and resolution of the electronic components, decrease physical size and decrease implementation costs as compared to embodiments that may use separate photo sensors and light emitting diodes. Embodiments described herein may facilitate fast and simple target setup and takedown, allow flexible target arrangements that cover multiple locations over a wide area and at varying distances, provide a wide variety of courses of fire with dynamically changing target patterns, allow hits within target zones to be detected for immediate feedback on accuracy and scoring, allow for use in a wide range of lighting conditions, provide audible and visual feedback of hits on targets, and provide low-cost implementation.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A firearm simulator target comprising:

a processor;

a memory module communicatively coupled to the processor;

a plurality of light emitting diodes communicatively coupled to the processor, wherein the plurality of light emitting diodes are arranged in a light emitting diode matrix such that the plurality of light emitting diodes are arranged in a plurality of columns of light emitting diodes and a plurality of rows of light emitting diodes, wherein the first light emitting diode is associated with a first row of light emitting diodes of the plurality of rows of light emitting diodes, and wherein the first light emitting diode is associated with a first column of light emitting diodes of the plurality of columns of light emitting diodes; and machine readable instructions stored in the memory module that cause the firearm simulator target to perform the following when executed by the processor:

illuminate a target pattern subset of the plurality of light emitting diodes such that the target pattern subset of the plurality of light emitting diodes are illuminated to display a target pattern, wherein the target pattern subset of the plurality of light emitting diodes that are illuminated includes a first light emitting diode;

reverse bias the first row of light emitting diodes to apply a voltage across the first row of light emitting diodes;

discharge the voltage across the first row of light emitting diodes;

determine a time to discharge the voltage across the first row of light emitting diodes;

determine the first row of light emitting diodes as a row hit location based on the time to discharge the voltage across the first row of light emitting diodes;

determine a voltage across the first column of light emitting diodes;

determine the first column of light emitting diodes as a column hit location based on the voltage across the first column of light emitting diode; and determine a target hit location as the first light emitting diode based on the row hit location and the column hit location.

2. The firearm simulator target of claim 1, wherein the machine readable instructions stored in the memory module cause the firearm simulator target to perform the following when executed by the processor:

receive at least one ambient light level signal from one or more of the plurality of light emitting diodes;

determine an ambient light level based on the received at least one ambient light level signal; and determine the target hit location based on the ambient light level.

3. The firearm simulator target of claim 1, further comprising network interface hardware communicatively coupled to the processor, wherein the machine readable instructions stored in the memory module cause the firearm simulator target to transmit a message including the target hit location with the network interface hardware.

4. The firearm simulator target of claim 1, further comprising network interface hardware communicatively coupled to the processor, wherein the machine readable instructions stored in the memory module cause the firearm simulator target to receive a message comprising a target pattern with the network interface hardware, and wherein the target pattern subset of the plurality of light emitting diodes are illuminated to display the target pattern.

5. A firearm simulator target comprising:

a processor;

a memory module communicatively coupled to the processor;

a plurality of light emitting diodes communicatively coupled to the processor, wherein the plurality of light emitting diodes are arranged in a light emitting diode matrix such that the plurality of light emitting diodes are arranged in a plurality of columns of light emitting diodes and a plurality of rows of light emitting diodes, wherein the first light emitting diode is associated with a first row of light emitting diodes of the plurality of rows of light emitting diodes, and wherein the first light emitting diode is associated with a first column of light emitting diodes of the plurality of columns of light emitting diodes; and machine readable instructions stored in the memory module that cause the firearm simulator target to perform the following when executed by the processor:

illuminate a target pattern subset of the plurality of light emitting diodes such that the target pattern subset of the plurality of light emitting diodes are illuminated to display a target pattern, wherein the target pattern subset of the plurality of light emitting diodes that are illuminated includes a first light emitting diode;

reverse bias the first column of light emitting diodes to apply a voltage across the first column of light emitting diodes;

discharge the voltage across the first column of light emitting diodes;

determine a time to discharge the voltage across the first column of light emitting diodes;

determine the first column of light emitting diodes as a column hit location based on the time to discharge the voltage across the first column of light emitting diodes;

determine a voltage across the first row of light emitting diodes;

determine the first row of light emitting diodes as a row hit location based on the voltage across the first row of light emitting diode; and determine a target hit location as the first light emitting diode based on the row hit location and the column hit location.

6. The firearm simulator target of claim 5, wherein the machine readable instructions stored in the memory module cause the firearm simulator target to perform the following when executed by the processor:

receive at least one ambient light level signal from one or more of the plurality of light emitting diodes;

determine an ambient light level based on the received at least one ambient light level signal; and determine the target hit location based on the ambient light level.

7. The firearm simulator target of claim 5, further comprising network interface hardware communicatively coupled to the processor, wherein the machine readable instructions stored in the memory module cause the firearm simulator target to transmit a message including the target hit location with the network interface hardware.

8. The firearm simulator target of claim 5, further comprising network interface hardware communicatively coupled to the processor, wherein the machine readable instructions stored in the memory module cause the firearm simulator target to receive a message comprising a target pattern with the network interface hardware, and wherein the target pattern subset of the plurality of light emitting diodes are illuminated to display the target pattern.

* * * * *